US011465433B2

(12) United States Patent
Godfrey et al.

(10) Patent No.: US 11,465,433 B2
(45) Date of Patent: Oct. 11, 2022

(54) SECURITY DEVICE AND METHOD OF MAKING THEREOF

(71) Applicant: DE LA RUE INTERNATIONAL LIMITED, Basingstoke (GB)

(72) Inventors: John Godfrey, Basingstoke (GB); Rebecca Locke, Basingstoke (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 55 days.

(21) Appl. No.: 16/627,252

(22) PCT Filed: Jun. 27, 2018

(86) PCT No.: PCT/GB2018/051794
§ 371 (c)(1),
(2) Date: Dec. 27, 2019

(87) PCT Pub. No.: WO2019/002855
PCT Pub. Date: Jan. 3, 2019

(65) Prior Publication Data

US 2020/0130396 A1 Apr. 30, 2020

(30) Foreign Application Priority Data

Jun. 30, 2017 (GB) ..... 1710499

(51) Int. Cl.
*B42D 25/324* (2014.01)
*B42D 25/351* (2014.01)
(Continued)

(52) U.S. Cl.
CPC ..... *B42D 25/324* (2014.10); *B41M 3/148* (2013.01); *B42D 25/351* (2014.10);
(Continued)

(58) Field of Classification Search
None
See application file for complete search history.

(56) References Cited

U.S. PATENT DOCUMENTS 4,434,010 A 2/1984 Ash
5,059,245 A 10/1991 Phillips et al.
(Continued)

FOREIGN PATENT DOCUMENTS

EP 0 059 056 A1 9/1982
EP 0 341 002 A2 11/1989
(Continued)

OTHER PUBLICATIONS

Sep. 17, 2020 Office Action issued in British Patent Application No. 1710499.3.
(Continued)

*Primary Examiner* — Laura C Powers
(74) *Attorney, Agent, or Firm* — Oliff PLC

(57) ABSTRACT

A security device is provided, comprising: a colour shifting element that exhibits different wavelengths of light at different viewing angles, and; an at least partially transparent light control layer covering at least a part of the colour shifting element and comprising a surface relief adapted to modify the angle of light from the colour shifting element, wherein; a first region of the light control layer comprises a first optical characteristic, whereby light at a first viewing angle from the first region of the light control layer is perceived to have a resultant optical effect that is the resultant of the wavelength of light exhibited at that viewing angle due to the combination of the colour shifting element and the surface relief of the light control layer, and the first optical characteristic, and; a second region of the light control layer either: (i) is substantially colourless such that light at the first viewing angle from the second region is perceived to have a resultant optical effect exhibited at that
(Continued)

viewing angle due to the combination of the colour shifting element and the surface relief of the light control layer, or; (ii) comprises a second optical characteristic different from the first optical characteristic, whereby light at the first viewing angle from the second region of the light control layer is perceived to have a resultant optical effect that is the resultant of the wavelength of light exhibited at that viewing angle due to the combination of the colour shifting element and the surface relief of the light control layer, and the second optical characteristic. Methods of manufacture thereof are also disclosed.

20 Claims, 21 Drawing Sheets

(51) Int. Cl.

| | |
|---|---|
| ***B42D 25/355*** | (2014.01) |
| ***B42D 25/364*** | (2014.01) |
| ***B42D 25/425*** | (2014.01) |
| ***B42D 25/23*** | (2014.01) |
| ***B42D 25/24*** | (2014.01) |
| ***B42D 25/29*** | (2014.01) |
| ***B41M 3/14*** | (2006.01) |

(52) U.S. Cl.
CPC ..... *B42D 25/355* (2014.10); *B42D 25/364* (2014.10); *B42D 25/425* (2014.10); *B42D 25/23* (2014.10); *B42D 25/24* (2014.10); *B42D 25/29* (2014.10)

(56) References Cited

U.S. PATENT DOCUMENTS

| | | | |
|---|---|---|---|
| 5,084,351 | A | 1/1992 | Philips et al. |
| 5,135,812 | A | 8/1992 | Phillips et al. |
| 5,171,363 | A | 12/1992 | Phillips et al. |
| 5,571,624 | A | 11/1996 | Phillips et al. |
| 2006/0077496 | A1 | 4/2006 | Argoitia et al. |
| 2009/0115185 | A1 | 5/2009 | Hoffmuller et al. |
| 2010/0270379 | A1 | 10/2010 | Lister et al. |

FOREIGN PATENT DOCUMENTS

| | | | |
|---|---|---|---|
| EP | 0 668 329 | A2 | 8/1995 |
| EP | 0 741 170 | A1 | 11/1996 |
| EP | 0 724 519 | B1 | 7/1997 |
| EP | 0 736 073 | B1 | 3/1998 |
| EP | 0 860 298 | A2 | 8/1998 |
| EP | 1 114 102 | B1 | 9/2002 |
| EP | 1 141 480 | B1 | 2/2004 |
| EP | 1 398 174 | A1 | 3/2004 |
| EP | 0 723 501 | B2 | 5/2005 |
| EP | 2 161 598 | A2 | 3/2010 |
| EP | 2 739 483 | B1 | 9/2015 |
| EP | 2 946 942 | A1 | 11/2015 |
| WO | 83/00659 | A1 | 3/1983 |
| WO | 00/39391 | A1 | 7/2000 |
| WO | 03/054297 | A2 | 7/2003 |
| WO | 03/095188 | A2 | 11/2003 |
| WO | 2009/066048 | A1 | 5/2009 |
| WO | 2013/017865 | A1 | 2/2013 |
| WO | 2013/022699 | A1 | 2/2013 |

OTHER PUBLICATIONS

Dec. 20, 2017 Office Action issued in British Patent Application No. 1710499.3.
Jul. 30, 2018 Office Action issued in British Patent Application No. 1710499.3.
Jul. 30, 2018 Search Report issued in British Patent Application No. 1710499.3.
Jul. 30, 2018 Search Report issued in British Patent Application No. 1710499.3 (2).
Nov. 19, 2018 International Search Report issued in International Patent Application No. PCT/GB2018/051794.
Nov. 19, 2018 Written Opinion of the International Searching Authority issued in International Patent Application No. PCT/GB2018/051794.

SECURITY DEVICE AND METHOD OF MAKING THEREOF

FIELD OF THE INVENTION

The present invention relates to security devices suitable for use in security documents such as banknotes, identity documents, passports, certificates and the like, as well as methods for manufacturing such security devices.

BACKGROUND TO THE INVENTION

To prevent counterfeiting and to enable authenticity to be checked, security documents are typically provided with one or more security devices which are difficult or impossible to replicate accurately with commonly available means such as photocopiers, scanners or commercial printers.

One well known type of security device is one which uses a colour shifting element to produce an optically variable effect that is difficult to counterfeit. Such a colour shifting element generates a coloured appearance which changes dependent on the viewing angle. Examples of known colour shifting structures include photonic crystals, liquid crystals, interference pigments, pearlescent pigments, structured interference materials or thin film interference structures including Bragg stacks.

It is also known in the art that the optical effect produced by a colour shifting element can be modified by introducing a film comprising a surface relief over the colour shifting element, wherein the surface relief comprises a plurality of angled facets that refract the light incident to, and reflected from, the colour shifting element so as to provide a different optical effect to the viewer. For example, such an additional "light control layer" may produce colour shifting effects which are visible closer to a normal angle of viewing with respect to the device, and may enable more colours to be viewed on tilting the device as compared to the colour shifting element in isolation.

However, although such devices provide authentication capability and are difficult to counterfeit, there is the ever-continuing requirement to further increase the security of such devices.

SUMMARY OF THE INVENTION

According to a first aspect of the invention there is provided a security device comprising: a colour shifting element that exhibits different wavelengths of light at different viewing angles, and; an at least partially transparent light control layer covering at least a part of the colour shifting element and comprising a surface relief adapted to modify the angle of light from the colour shifting element, wherein; a first region of the light control layer comprises a first optical characteristic, whereby light at a first viewing angle from the first region of the light control layer is perceived to have a resultant optical effect that is the resultant of the wavelength of light exhibited at that viewing angle due to the combination of the colour shifting element and the surface relief of the light control layer, and the first optical characteristic, and; a second region of the light control layer either: (i) is substantially colourless such that light at the first viewing angle from the second region is perceived to have a resultant optical effect exhibited at that viewing angle due to the combination of the colour shifting element and the surface relief of the light control layer, or; (ii) comprises a second optical characteristic different from the first optical characteristic, whereby light at the first viewing angle from the second region of the light control layer is perceived to have a resultant optical effect that is the resultant of the wavelength of light exhibited at that viewing angle due to the combination of the colour shifting element and the surface relief of the light control layer, and the second optical characteristic.

The inventors have realised that they can provide a security device that provides a striking visual effect to a viewer through the combination of optical effects provided by the colour shifting element and the light control layer having a first optical characteristic. The first and/or second optical characteristic may be any of: a visible colour, fluorescence, luminescence and phosphorescence.

Typically, the first and/or second optical characteristic is a visible colour, and the resultant optical effect to a viewer of the device is a perceived colour which is the resultant (or "mixing") of the wavelength of light exhibited by the colour shifting element with the visible colour of the light control layer. It is envisaged that at least at one viewing angle, under illumination by visible light, the wavelength of light exhibited by the colour shifting element will be in the visible light range and therefore seen by the naked human eye as a visible colour.

The resultant optical effect exhibited to a viewer of the device may be a perceived colour which may be a colour exhibited at least in part by fluorescence, luminescence and/or phosphorescence effects. This is particularly advantageous as the resultant optical effect may be exhibited to a viewer of the device only under illumination of the device by non-visible light, such as infra-red or ultraviolet illumination. This is particularly beneficial for security applications.

Throughout this specification, the term "visible colour" means a colour which can be seen by the naked human eye under the stated illumination conditions. This includes achromatic hues such as black, grey, white, silver etc., as well as chromatics such as red, blue, yellow, green, brown etc. "Substantially the same" colours are those which appear the same as one another in a cursory inspection (by the naked human eye) although they may not be an exact match under close examination. By the same logic, "different" colours are those which clearly present a contrast to one another that is visible to the naked human eye even without a close inspection. The difference might be in terms of the colour's hue or tone or both.

For example, in preferred embodiments, two colours will be considered substantially the same as one another if the Euclidean distance $\Delta E^*_{ab}$ between them in CIELAB colour space (i.e. the CIE 1976 L*a*b* colour space) is less than 3, more preferably less than 2.3. The value of $\Delta E^*_{ab}$ is measured using the formula $$\Delta E^*_{ab}=\sqrt{(\Delta L^*)^2+(\Delta a^*)^2+(\Delta b^*)^2}$$

Where ΔL*, Δa* and Δb* are the distance between the two colours along the L*, a* and b* axes respectively (see "Digital Color Imaging Handbook" (1.7.2 ed.) by G. Sharma (2003), CRC Press, ISBN 0-8493-0900-X, pages 30 to 32). Conversely, if $\Delta E^*_{ab}$ is greater than or equal to 3 (or, in more preferred embodiments, greater than or equal to 2.3), the two colours will be considered different. The colour difference $E^*_{ab}$ can be measured using any commercial spectrophotometer, such as those available from Hunterlab of Reston, Va., USA.

Throughout this specification, the term "light" refers to both visible light (see below) and non-visible light outside the visible spectrum, such as infra-red and ultraviolet radiation. "Visible light" refers to light having a wavelength within the visible spectrum, which is approximately 400 to 750 nm. It is most preferable that the visible light is white light, i.e. contains substantially all the visible wavelengths in more or less even proportion. The ultra-violet spectrum typically comprises wavelengths from about 200 nm to about 400 nm, and the infra-red spectrum typically comprises wavelengths from about 750 nm to 1 mm.

Although it will be understood by the skilled person that the resultant optical effect of the device may include a contribution from fluorescence, luminescence and/or phosphorescence effects, for ease of understanding and explanation, the following description will focus on the scenario where the optical characteristic(s) are a visible colour, such that the resultant optical effect is the result of a combination, or "mixing" of the colour exhibited by the colour shifting element at a certain wavelength with the visible colour of the light control layer.

Typically the optical characteristic will be such that the respective region of the light control layer absorbs a particular wavelength, or range of wavelengths, of visible light such that it appears coloured to a viewer (and therefore may be referred to an "optical absorption characteristic"). However, the light control layer remains at least partially transparent, here meaning that visible light is able to pass through it such that light from the colour shifting element passes through the light control layer and reaches the viewer. The term "partially transparent" may also include "translucent". The optical characteristic may also determine the level of transparency of the light control layer, as will be explained below. For the purposes of this discussion, and for ease of explanation, we shall refer to regions of the light control layer having an optical characteristic of a visible colour as having a coloured tint.

The expression "surface relief" is used to refer to a non-planar part of the outwardly facing surface of light control layer. The surface relief typically has a plurality of facets so as to define a plurality of elevations and depressions. Light from the colour shifting element is refracted at the interface between the angled facets of the surface relief and air, and in this way the light control layer interacts with light from the colour shifting element to modify the angle of light from the colour shifting element. The surface relief of the invention typically has a pitch (e.g. the distance between adjacent elevations) in the range of 1-100 μm, more preferably 5-70 μm, and structure depth (e.g. the height of an elevation) in the range of 1-100 μm, more preferably 5-40 μm. The surface relief also refracts light incident upon its facets, modifying the angle of light incident on the colour shifting element.

This means that the resultant colour exhibited to a viewer is a combination of the colours exhibited by the colour shifting element and the coloured tint of the light control layer, and advantageously enables a number of striking effects to be exhibited by the device, utilising the effects of the colour shifting element, the surface relief of the light control layer and the tinting of the light control layer.

The light control layer covers at least a part of the colour shifting element and is typically positioned between the light control layer and the observer of the security device.

In particular, the security device of the first aspect comprises a light control layer having first and second regions with different optical characteristics, such that the different regions will exhibit different colours to a viewer. Furthermore, each region may change colour upon tilting the device due to the effect of the colour shifting element. Here "tilting" refers to tilting of the security device so as to change the viewing angle.

The second region of the light control layer may be substantially colourless. In other words, the second region does not comprise a "tint" as described above, and the exhibited effect from the second region at a particular viewing angle is due to the combination of the colour shifting element and the surface relief of the second region. In other words, there is no "mixing" of colours as with the first region of the light control layer.

Alternatively, the second region of the light control layer may comprise a second optical characteristic different to the first optical characteristic. In some embodiments the first optical characteristic is such that the first region exhibits a first visible colour and the second optical characteristic is such that the second region exhibits a second, different visible colour. For example, the first region of the light control layer may exhibit a yellow tint and the second region of the light control layer may exhibit a red tint. When combined with a colour shifting element that exhibits a red to green colour shift upon tilting (i.e. red at a normal angle of viewing, green when tilted), at a first (normal) viewing angle, the first region will appear orange due to a combination of red and yellow light, and the second region will appear dark red, due to a combination of the red light from the colour shifting element and the red tint of the second region of the light control layer.

When considering the exhibited effect upon tilting the device, it is first helpful to consider what the exhibited effect would be without the tinting of the light control layer. Upon tilting, blue light from the colour shifting element that would normally be totally internally reflected and not visible to a viewer is now in fact visible to a viewer due to the presence of the light control layer. Therefore, the presence of the light control layer causes a red to green to blue colour shift to be exhibited rather than simply a red to green colour shift that would be observed from such a colour shifting element in isolation. Combining this with the tinting of the first and second regions of the light control layer, we can see that the exhibited effect on tilting the device will be that the first region appears turquoise (a mixing of blue and yellow light), and the second region appears purple (a mixing of blue and red light).

In some embodiments, the first optical characteristic is such that the first region and the second region exhibit substantially the same visible colour, wherein a level of transparency of the first region is different to a level of transparency of the second region such that the resultant perceived colours exhibited by the first and second regions are different. For example, both the first and second regions of the light control layer may exhibit a yellow colour, but the tint concentration in the first region is greater than that in the second region. This would mean that the first region is less transparent (lower transparency level) than the second region, meaning that that the ratio of colour shifting element colour to tint colour is lower in the first region than in the second region. As a result, the resultant colours exhibited to a viewer from the first and second regions differ.

The first and second optical characteristics may be such that the first region and second region exhibit substantially the same wavelength of fluorescence, luminescence or phosphorescence emission, wherein a concentration of fluorescent, luminescent or phosphorescent material differs between the first and second regions.

Typically, due to the effect of the colour shifting element, at a first viewing angle, the light from the first region of the light control layer is perceived to have a first resultant colour and, at a second viewing angle, the light from said first region of the light control layer is perceived to have a second resultant colour different from the first resultant colour. Similarly, at a first viewing angle, the light from the second region of the light control layer is perceived to have a first resultant colour and, at a second viewing angle, the light from the second region of the light control layer is perceived to have a second resultant colour different from the first resultant colour.

A particularly striking effect can be exhibited if the device is configured such that at at least one viewing angle, the first and second regions of the light control layer exhibit substantially the same resultant colour, and at a second viewing angle, the first and second regions exhibit different resultant colours. For example, the colour shifting element may exhibit a red to green (and to blue when in combination with the light control layer) colour shift, as described above. If the first region has an optical characteristic such that it exhibits a red tint, and the second region is substantially colourless, then, at a normal angle of viewing, the resultant colour exhibited by both regions will be red. However, upon tilting, the first region will exhibit a purple colour (a combination of blue light from the colour shifting element and red from the light control layer), and the second region will exhibit a blue colour as the blue light from the colour shifting element will be visible through the colourless region. This "hidden image" effect is particularly striking, and improves security of the device. A similar effect may be achieved when the second region comprises a second optical characteristic, with both the first and second regions having different levels of transparency.

In preferred embodiments, the first and/or second regions define indicia, and this is particularly advantageous in "hidden image" applications as described above. Typically such indicia comprises at least a digit, letter, geometric shape, symbol, image, graphic or alphanumerical text The first and second regions of the light control layer may substantially abut each other or may be spaced apart. In the case where they are spaced apart, the region between the first and second regions of the light control layer may be described as a "non-functional" region of the light control layer in that is does not substantially modify the angle of light from the colour shifting element. The non-functional region may therefore comprise a substantially planar portion of light control layer material substantially parallel with the plane of the colour shifting element (i.e. does not comprise a surface relief), or may comprise no light control layer material, such that the colour shifting element is exposed between the first and second regions. In this second case the first and second regions are still part of the same light control layer. The use of first and second regions spaced apart by a non-functional region provides the ability to exhibit further coloured effects.

For further striking effects exhibited by the security device, the light control layer may further comprise a third region that either: (i) is substantially colourless such that light at the first viewing angle from the third region is perceived to have a resultant optical effect exhibited at that viewing angle due to the combination of the colour shifting element and the surface relief of the light control layer, or; (ii) comprises a third optical characteristic different from the first and second optical characteristics, whereby light at the first viewing angle from the third region of the light control layer is perceived to have a resultant optical effect that is the resultant of the wavelength of light exhibited at that viewing angle due the combination of the colour shifting element and the surface relief of the light control layer, and the third optical characteristic.

According to a second aspect of the invention, there is provided a security device comprising: a colour shifting element that exhibits different wavelengths of light at different viewing angles; an at least partially transparent light control layer covering at least a part of the colour shifting element and comprising a surface relief adapted to modify the angle of light from the colour shifting element, and; an optical characteristic layer positioned between the colour shifting element and the light control layer, or positioned on a distal side of the colour shifting element with respect to the light control layer, wherein at least a first region of the optical characteristic layer comprises a first optical characteristic such that it exhibits a first optical effect at substantially all viewing angles; whereby light at a first viewing angle from the first region is perceived to have a first optical effect that is the resultant of the wavelength of light exhibited at that viewing angle due to the combination of the colour shifting element and the surface relief of the light control layer, and the first optical characteristic.

The second aspect of the invention utilises the same inventive principles of the first aspect, in that the final resultant optical effect exhibited to a viewer is the resultant of the wavelength of light exhibited at a particular viewing angle due to the combination of the colour shifting element and the surface relief of the light control layer, and a further element comprising an optical characteristic. In this case, rather than the material of the light control layer comprising a first optical characteristic, the device comprises an at least partially transparent optical characteristic layer, at least a first region thereof exhibiting a first optical effect at substantially all viewing angles. In other words, the first region of the optical characteristic layer may be seen to exhibit a "uniform" or "homogenous" optical effect, for example the same colour at all viewing angles.

The optical characteristic layer typically at least partially covers (at least partially overlaps with) with the colour shifting element. In other words, the optical characteristic layer typically covers at least a first region of the colour shifting element.

In a similar manner to the first aspect, although the first optical characteristic may be any of: a visible colour, fluorescence, luminescence and phosphorescence, for ease of description and explanation, we shall focus on the first optical characteristic being a visible colour (and thus an "optical absorption characteristic").

In some embodiments, the colour shifting element is at least partially transparent (for example a liquid crystal element) and the optical characteristic layer is positioned between the colour shifting element and the light control layer, or on a distal side of the colour shifting element with respect to the light control layer. In the case where the colour shifting element is at least partially transparent, the optical characteristic layer may be substantially opaque or at least partially transparent. Where the optical characteristic layer is substantially opaque, it is positioned on a distal side of the colour shifting element with respect to the light control layer such that the resultant optical effect exhibited to a viewer will still be the resultant of the optical effects exhibited by the optical characteristic layer and the combination of the colour shifting element and surface relief at that viewing angle.

The optical characteristic layer may comprise an ink layer, or comprise a polymer layer such as polycarbonate, PET or BOPP. Examples of materials used to effect the optical characteristic(s) in order to provide tinted regions of the optical characteristic layer include conventional dyes or pigments which are applied to the polymer resin. Such methods for tinting/colouring polymer materials are well known in the art. One example range of colourants would be the BASF Orasol® product range.

A substrate of the security device (for example a polycarbonate, PET or BOPP substrate) may act as the optical characteristic layer. Examples may include at least partially transparent polycarbonate with a coloured "tint", or a deep-dyed PET or BOPP film, such as from CPFilms Inc, a subsidiary of Eastman Chemical Company.

Typical substrate thicknesses that may be used in the invention are in the range of 10-200 microns, more preferably 15-100 microns and even more preferably 15-40 microns.

The term "partially transparent" here has the same meaning as described above, in that visible light is able to pass through the coloured layer. The term "partially transparent" may include "translucent". The term "substantially opaque" here means that visible light cannot pass through the opaque layer.

In other embodiments, the colour shifting element is substantially opaque (for example an optically variable pigment), and the optical characteristic layer is at least partially transparent and positioned between the colour shifting element and the light control layer.

In some embodiments, the optical characteristic layer comprises a second region having a second optical characteristic such that the second region exhibits a second optical effect at substantially all viewing angles different to the first optical effect.

Similarly to the description of the first and second regions of the light control layer described above, the use of an optical characteristic layer comprising first and second regions having different optical characteristics provides a striking effect to a viewer, in that the device will exhibit different regions having different optical effects. This is particularly advantageous when the first region and/or second region of the optical characteristic layer define indicia.

Similarly to as described above in relation to the first aspect of the invention, in some embodiments where the optical characteristic layer is at least partially transparent, the second region comprises a transparency level that is different to a transparency level of the first region of the optical characteristic layer. In such a case, the first and second regions will exhibit different resultant colours due to the different levels of "mixing" of colour from the colour shifting element and the coloured layer resulting from the differing transparency levels.

The first and second optical characteristics may be such that the first region and second region exhibit substantially the same wavelength of fluorescence, luminescence or phosphorescence emission, wherein a concentration of fluorescent, luminescent or phosphorescent material differs between the first and second regions.

Further striking visual effects, and increased security levels, can be achieved by using a light control layer having an optical characteristic similarly to as described in the first aspect of the invention. Accordingly, in some embodiments, the light control layer comprises at least a first region comprising a light control layer optical characteristic. Preferably, the first region of the light control layer corresponds to the first region of the optical characteristic layer; whereby light at a first viewing angle from the first region of the light control layer is perceived to have a resultant optical effect that is the resultant of the wavelength of light exhibited at that viewing angle due to the combination of the colour shifting element and the surface relief of the light control layer, the first optical characteristic of the optical characteristic layer and the light control layer optical characteristic.

In other embodiments, the light control layer may comprise further regions having different light control layer optical characteristics that may cooperate with the optical characteristic layer and/or the colour shifting element in order to generate further visual effects. In some embodiments, the light control layer may comprise a region having a light control layer optical characteristic that does not overlap with a region of the optical characteristic layer—for example the optical characteristic layer may have comprise "non-functional" or "gap" regions. The visual effect from such a region will be the combination of the colour shifting element and the surface relief of the light control layer, and the light control layer optical characteristic.

The light control layer optical characteristic may be any one of: a visible colour, fluorescence, luminescence and phosphorescence.

In the case where the optical characteristics of the optical characteristic layer and the light control layer are a visible colour, the resultant optical effect exhibited to a user is a combination (or "mixing") of three different effects: the colour exhibited by the combination of colour shifting element and light control layer, the "tint" of the light control layer, and the colour of the coloured layer. This advantageously allows fine control of the visual effect exhibited by the device, together with enhanced security as would-be counterfeiters would have difficulty in determining the exact colour ratios that combine to form the resultant colours exhibited at various angle of tilt.

Here, where the first region of the light control layer corresponds to the first region of the optical characteristic layer, it is typically meant that the first region of the light control layer at least partially overlaps with the first region of the optical characteristic layer such that light from the optical characteristic layer travels through the first region of the light control layer before being observed by the viewer.

Preferably, at least the first region of the at least partially transparent optical characteristic layer defines indicia.

According to a third aspect of the present invention there is provided a security device comprising: a colour shifting element that exhibits different wavelengths of light at different viewing angles; an at least partially transparent light control layer covering at least a part of the colour shifting element and comprising a surface relief adapted to modify the angle of light from the colour shifting element, and; a substantially opaque layer having a first optical characteristic positioned between the colour shifting element and the light control layer and covering a first region of the colour shifting element, wherein; a first region of the light control layer comprises a second optical characteristic, whereby light at a first viewing angle from the first region of the light control layer is perceived to either: (i) have a resultant optical effect that is the resultant of the first optical characteristic and the second optical characteristic, when the first region of the light control layer overlaps with the opaque layer, or; (ii) have a resultant optical effect that is the resultant of the wavelength of light exhibited at that viewing angle due to the combination of the colour shifting element and the surface relief of the light control layer, and the second optical characteristic, when the first region of the light control layer does not overlap with the opaque layer.

The first optical characteristic may be any one of: a visible colour, fluorescence, luminescence and phosphorescence. Similarly the second optical characteristic may be any one of: a visible colour, fluorescence, luminescence and phosphorescence.

The term "substantially opaque" here means that visible light cannot pass through the opaque layer. Therefore, in the case where the first region of the light control layer overlaps with the opaque layer, light from the colour shifting element cannot pass through the opaque layer and the resultant optical effect exhibited to the viewer is the resultant (or "mixing") of the optical characteristics of the opaque layer and the first region of the light control layer.

Where the substantially opaque layer does not overlap with the colour shifting element, the resultant optical effect is the resultant of the wavelength of light exhibited at that viewing angle due to the combination of the colour shifting element and the surface relief of the light control layer, and the second optical characteristic. This effect can be advantageously used so that the substantially opaque region covers a first part of the colour shifting element so as to define indicia. Preferably the indicia is/are exhibited to a viewer of the security device as regions of different colour as a result of the overlap between the substantially opaque region and the colour shifting element.

In some embodiments, a second region of the light control layer is substantially colourless such that light at the first viewing angle from the second region is perceived to either: (i) have a resultant optical effect that is the resultant of the first optical characteristic, when the second region of the light control layer overlaps with the opaque layer, or; (ii) have a resultant optical effect that is the resultant of the wavelength of light exhibited at that viewing angle due to the combination of the colour shifting element and the surface relief of the light control layer, when the second region does not overlap with the opaque layer. The first and second regions of the light control layer may both overlap with the same part of the opaque layer and/or may both overlap with the same part of the colour shifting element.

Preferably, the substantially opaque layer covers a first part of the colour shifting element so as to define indicia, and typically the indicia is exhibited to a viewer of the security device as regions of different optical effects as a result of the overlap between the substantially opaque layer and the colour shifting element.

Typically, the optical characteristic of the opaque layer is exhibited at substantially all viewing angles.

In some preferred embodiments, the first optical characteristic of the substantially opaque layer is a visible colour substantially corresponding to the wavelength of light exhibited by the colour shifting element at a first viewing angle such that, at said first viewing angle, the device exhibits a substantially uniform colour and at a second viewing angle different to the first viewing angle, the device exhibits different regions of colour corresponding at least to the first region of the colour shifting element covered by the opaque layer. The feature advantageously uses the variable nature of the colour shifting element to allow the device to reveal a "hidden image" upon tilting. For example if, at a first viewing angle, the colour shifting element exhibits a red colour, then the opaque layer may be made to have substantially the same red colour. Subsequently, with a first region of the light control layer covering both the opaque layer and the exposed colour shifting element, the resultant colour exhibited to a viewer from both areas of the device will be the same, giving rise to a uniform colour. However, upon tilting of the device, the colour shifting element will exhibit a different colour, meaning that the exposed region of the colour shifting element will exhibit a different resultant colour to that exhibited by the opaque layer region (as light from the colour shifting element cannot pass through the opaque region). In this manner, if the opaque layer is provided so as to define indicia, the indicia will only be revealed upon tilting the device, providing a striking visual effect to a viewer.

The substantially opaque layer may comprise an ink layer, or comprise a polymer layer such as polycarbonate, PET or BOPP. Examples of materials used to effect the optical characteristic(s) in order to provide the required opacity of the opaque layer include conventional dyes or pigments, and such methods for colouring polymer materials are well known in the art. One example range of colourants would be the BASF Orasol® product range.

A substrate of the security device may act as the substantially opaque layer.

In any of the first, second and third aspects described above, the expression "colour shifting element" is used to refer to any material which can selectively reflect or transmit incident light to create an optically variable effect, in particular an angularly dependent coloured reflection or transmission. It is envisaged that at least at one viewing angle, under illumination by visible light, the wavelength (or range of wavelengths) of light exhibited by the colour shifting element will be in the visible light range and therefore seen by the naked human eye as a visible colour. Under non-visible light illumination, the wavelength (or range of wavelengths) of light exhibited by the colour shifting element may be in the non-visible light range.

Examples of such a colour shifting element include photonic crystals, liquid crystals, interference pigments, pearlescent pigments, structured interference materials or thin film interference structures including Bragg stacks. A particularly suitable material for the colour shifting element is a liquid crystal film. The colour shifting element is typically a layer of a security device.

In general the colour shifting element may be substantially opaque or partially transparent (with various examples having been described above). A partially transparent colour shifting element (for example a liquid crystal film) transmits at least some of the light that is incident upon it as well as providing an optical effect in reflection. An example of a substantially opaque colour shifting element is an optically variable pigment. Optically variable pigments having a colour shift between two distinct colours, with the colour shift being dependent on the viewing angle, are well known. The production of these pigments, their use and their characteristic features are described in, inter-alia, U.S. Pat. Nos. 4,434,010, 5,059,245, 5,084,351, 5,135,812, 5,171,363, 5,571,624, EP-A-0341002, EP-A-0736073, EP-A-668329, EP-A-0741170 and EP-A-1114102. Optically variable pigments having a viewing angle-dependent shift of colour are based on a stack of superposed thin-film layers with different optical characteristics. The hue, the amount of colour-shifting and the chromaticity of such thin-film structures depend inter alia on the material constituting the layers, the sequence and the number of layers, the layer thickness, as well as on the production process. Generally, optically variable pigments comprise an opaque totally reflecting layer, a dielectric layer of a low refractive index material (i.e. with an index of refraction of 1.65 or less) deposited on top of the opaque layer and a semi-transparent partially reflecting layer applied on the dielectric layer.

The security device may be viewed in reflection or transmission. If the device is intended to be viewed in reflection and comprises a partially transparent colour shifting element such as a liquid crystal film, it is preferable that the security device further comprises an absorbing element positioned on a distal side of the colour shifting element with respect to the light control layer (i.e. such that the colour shifting element is positioned between the light-absorbing material and the viewer) and operable to at least partially absorb light transmitted through the colour shifting element. Such a light-absorbing element positioned under the colour shifting element substantially absorbs light that is transmitted through the colour shifting element and light reflected from the colour shifting element dominates. In the case where a substantially opaque colour shifting element is used, such an absorbing element is not required. In some embodiments, such an absorbing element may be provided in the form of indicia, such that, when viewed in reflected light, the colour shifting element is visible in the form of the indicia.

The first, second and third aspects described above all refer to a light control layer comprising a surface relief. The light control layer may be formed in a single step, for example by an embossing, extrusion or cast curing process. An embossing die is typically provided having a surface structure corresponding to the desired light control layer. The light control layer typically comprises a UV curable material. Suitable UV curable materials may comprise a polymeric material which may typically be of one of two types of polymeric resin, namely:

a) Free radical cure resins, which are typically unsaturated resins or monomers, pre-polymers, oligomers etc. containing vinyl or acrylate unsaturation for example and which cross-link through use of a photo initiator activated by the radiation source employed e.g. UV.

b) Cationic cure resins, in which ring opening (e.g. epoxy types) is effected using photo initiators or catalysts which generate ionic entities under the radiation source employed e.g. UV. The ring opening is followed by intermolecular cross-linking.

The radiation used to effect curing is typically UV radiation but could comprise electron beam, visible, or even infra-red or higher wavelength radiation, depending upon the material, its absorbance and the process used. Examples of suitable curable materials include UV curable acrylic based clear embossing lacquers or those based on other compounds such as nitro-cellulose. A suitable UV curable lacquer is the product UVF-203 from Kingfisher Ink Limited or photopolymer NOA61 available from Norland Products. Inc., New Jersey.

The curable material could be elastomeric and therefore of increased flexibility. An example of a suitable elastomeric curable material is aliphatic urethane acrylate (with suitable cross-linking additive such as polyaziridine).

A number of different surface reliefs of the light control layer are envisaged. For example, the surface relief may comprise two or more arrays of linear microprisms, wherein the long axes of one array are angularly offset from the axes of the other array. A light control layer comprising such a surface structure would provide a rotational optical effect as well as the colour shifting effect dependent on a tilt angle of the security device, wherein the rotational effect is dependent on the azimuthal angle of viewing with respect to the arrays of linear microprisms. The optical effect due to the presence of a microprism array will be more readily observed when the device is viewed in an azimuthal direction perpendicular to the long axes of the array rather than in an azimuthal direction parallel to the long axes of the array.

Other forms of microprismatic structures are envisaged, for example structures comprising microprisms having an asymmetrical structure or a repeating faceted structure.

The microstructure may be a one dimensional microstructure. By "one dimensional" it is meant that optical effect provided by the microstructure is primarily observed in one rotational viewing direction with respect to an individual microstructure, typically perpendicular to a long axis of the microstructure. However, a surface relief comprising a two dimensional microstructure is also envisaged wherein the optical effect due to the presence of the microstructure is readily observed at two or more rotational viewing directions. Examples of such a two-dimensional microstructure include corner cubes and pyramidal structures. The surface relief may alternatively comprise a lenticular array having a curved surface structure.

Examples of materials used to effect the optical characteristic(s) in order to provide tinted regions of the light control layer include conventional dyes or pigments which are applied to the polymer resin. Such methods for tinting/colouring polymer materials are well known in the art. One example range of colourants would be the BASF Orasol® product range.

In a similar manner, suitable fluorescent, luminescent or phosphorescent materials may be applied to the light control layer material (and where appropriate the optical characteristic layer or opaque layer) in order to effect the desired fluorescent, luminescent or phosphorescent material optical characteristic.

In accordance with a fourth aspect of the present invention there is provided a security article comprising a security device according to any of the first, second or third aspects, wherein the security article is preferably a security thread, strip, patch, label, transfer foil or a polymer substrate. In embodiments, a polymer substrate such as polycarbonate, PET or BOPP could act as the optical characteristic layer or substantially opaque layer in a similar manner to as described above. Typical substrate thicknesses that may be used in the invention are in the range of 10-200 microns, more preferably 15-100 microns and even more preferably 15-40 microns.

In accordance with a fifth aspect of the present invention there is provided a security document comprising a security article according to the fourth aspect, or a security device according to any of the first, second or third aspects. The security device or article may be located in a transparent window region of the document, or inserted as a window thread, or affixed to a surface of the document. Where the security article is a polymer substrate, the polymer substrate is typically a laminate for a data page of security document such as a passport or identification card. Another scenario is that the polymer substrate could be the substrate of a polymer banknote i.e. the security device is formed directly on the polymer banknote substrate. The security document preferably comprises a banknote, identity document, passport, cheque, visa, license, certificate or stamp.

In accordance with a sixth aspect of the invention there is provided a method of manufacturing a security device, the method comprising: providing an at least partially transparent light control layer so as to cover at least a part of a colour shifting element that exhibits different wavelengths of light at different viewing angles, wherein; the light control layer comprises a surface relief adapted to modify the angle of light from the colour shifting element, and further wherein; a first region of the light control layer comprises a first optical characteristic, whereby light at a first viewing angle from the first region of the light control layer is perceived to have a resultant optical effect that is the resultant of the wavelength of light exhibited at that viewing angle due to the combination of the colour shifting element and the surface relief of the light control layer, and the first optical characteristic, and; a second region of the light control layer either: (i) is substantially colourless such that light at the first viewing angle from the second region is perceived to have a resultant optical effect exhibited at that viewing angle due to the combination of the colour shifting element and the surface relief of the light control layer, or; (ii) comprises a second optical characteristic different from the first optical characteristic, whereby light at the first viewing angle from the second region of the light control layer is perceived to have a resultant optical effect that is the resultant of the wavelength of light exhibited at that viewing angle due the combination of the colour shifting element and the surface relief of the light control layer, and the second optical characteristic.

In accordance with a seventh aspect of the invention there is provided a method of manufacturing a security device, the method comprising: providing an at least partially transparent light control layer covering at least a part of a colour shifting element that exhibits different wavelengths of light at different viewing angles, wherein; the light control layer comprises a surface relief adapted to modify the angle of light from the colour shifting element, and wherein the method further comprises; providing an optical characteristic layer positioned between the colour shifting element and the light control layer, or positioned on a distal side of the colour shifting element with respect to the light control layer, wherein at least a first region of the optical characteristic layer comprises a first optical characteristic such that it exhibits a first optical effect at substantially all viewing angles; whereby light at a first viewing angle from the first region is perceived to have a first optical effect that is the resultant of the wavelength of light exhibited at that viewing angle due to the combination of the colour shifting element and the surface relief of the light control layer, and the first optical characteristic.

In accordance with an eighth aspect of the invention there is provided a method of manufacturing a security device, the method comprising: providing an at least partially transparent light control layer covering at least a part of a colour shifting element that exhibits different wavelengths of light at different viewing angles, wherein; the light control layer comprises a surface relief adapted to modify the angle of light from the colour shifting element, and wherein the method further comprises; providing a substantially opaque layer having a first optical characteristic positioned between the colour shifting element and the light control layer and covering a first region of the colour shifting element, wherein; a first region of the light control layer comprises a second optical characteristic, whereby light at a first viewing angle from the first region of the light control layer is perceived to either: (i) have a resultant optical effect that is the resultant of the first optical characteristic and the second optical characteristic, when the first region of the light control layer overlaps with the opaque layer, or; (ii) have a resultant optical effect that is the resultant of the wavelength of light exhibited at that viewing angle due to the combination of the colour shifting element and the surface relief of the light control layer, and the second optical characteristic, when the first region of the light control layer does not overlap with the opaque layer.

The resulting devices of the methods of the sixth, seventh and eighth aspects provide the benefits already described above.

In each of the sixth, seventh and eighth aspects, the colour shifting element may comprise one of: a photonic crystal structure, a liquid crystal material, an interference pigment, a pearlescent pigment, a structured interference material, or a thin film interference structure such as a Bragg stack.

Typically, the light control layer is provided by one of embossing, extrusion or cast curing.

BRIEF DESCRIPTION OF THE DRAWINGS

Examples of the invention will now be described with reference to the attached drawings, in which.

DETAILED DESCRIPTION OF THE DRAWINGS

As outlined above in the summary of the invention section, the optical characteristic of the light control layer, optical characteristic layer or substantially opaque layer may be one of a visible colour, fluorescence, luminescence and phosphorescence. In the following description, we shall focus on the optical characteristic being a visible colour for ease of description, although the skilled person will understand the possibility of use of fluorescence, luminescence and/or phosphorescence effects.

Figure 1A:
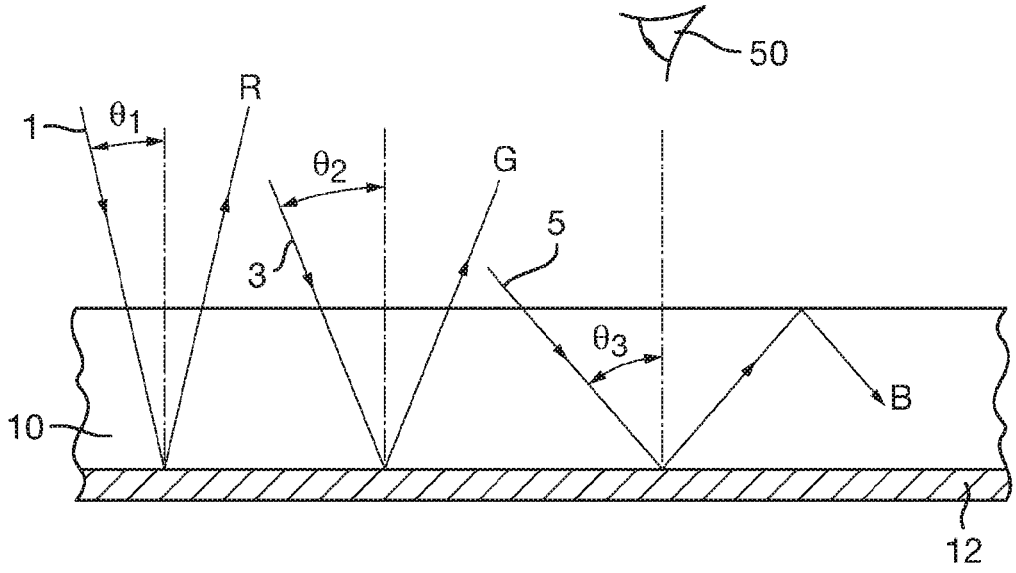
FIGS. 1*a* and 1*b* are schematic cross-sectional diagrams of the effect of light incident upon a colour shifting element, with and without the presence of a light control layer.
Figure 1B:
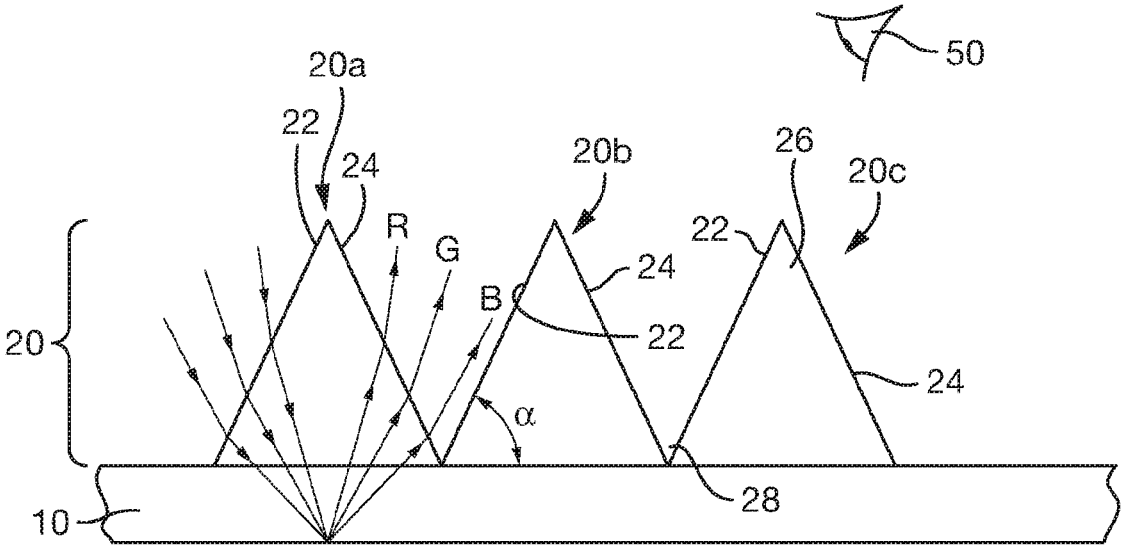

FIGS. 1*a* and 1*b* outline the general principles of the effect of providing a light control layer having a surface relief above a colour shifting element. FIG. 1*a* is a schematic cross-sectional diagram of the effect of light incident upon a colour shifting element 10. All types of colour shifting materials may be used as the colour shifting element in the present invention, including inter alia photonic crystals, liquid crystals, interference pigments, pearlescent pigments, structured interference materials or thin film interference structures including Bragg stacks.

When light strikes the colour shifting element 10, some of the light is reflected. The wavelength of the reflected light depends on the structure and composition of the colour shifting material 10 and the reflected light will appear coloured to the viewer 50. The wavelength of the reflected light is also dependent on the angle of incidence, which results in a colour change perceived by the viewer 50 as the colour shift layer is tilted.

The optical effects of the colour shifting element 10 are illustrated schematically in FIG. 1*a* by light rays 1, 3 and 5 shown at angles of incidence $\Theta_1$, $\Theta_2$ and $\Theta_3$ respectively, where $\Theta_1<\Theta_2<\Theta_3$. Due to the colour shifting properties of the colour shifting element 10, light incident upon the colour shifting element 10 with an angle of incidence $\Theta_1$ will appear red (R) to the viewer 50, and light incident with an angle of incidence $\Theta_2$ will appear green (G). At a greater angle of incidence $\Theta_3$, light reflected by the colour shifting element 10 will have a wavelength corresponding to a blue colour (B), but will be totally internally reflected and therefore not observable to the viewer. The colour shifting material 10 will therefore exhibit a red to green colour shift when viewed and tilted away from a normal angle of viewing. Typically, a colour shifting material will exhibit a change from longer wavelength to shorter wavelength light when viewed at a more acute angle (here red to green). However, the skilled person will appreciate that in some other instances a change from shorter to longer wavelengths may be exhibited.

The colour shifting element 10 can be viewed either in reflection or transmission. In the case of viewing in reflection, it is desirable to place a dark absorbing layer or element (shown at 12) beneath the colour shifting element 10 in order to absorb the transmitted light. This is particularly beneficial if the colour shifting element is partially transparent to visible light (for example a cholesteric liquid crystal layer). If a substantially opaque colour shifting element (such as a printed ink comprising an optically variable pigment) is used, such an absorbing layer 12 is not required for viewing in reflected light.

FIG. 1*b* illustrates a light control layer 20 positioned in contact with a top surface of the colour shifting element 10 such that the light control layer 20 is situated between the colour shifting element 10 and the viewer 50. The light control layer preferably has a microprismatic structure (here an array of symmetrical linear triangular microprisms 20*a*, 20*b*, 20*c* having equal length facets 22, 24 at an angle $\alpha$ to the colour shifting element 10 and having long axes that extend into the plane of the page) having a series of elevations and depressions shown generally at 26 and 28 respectively, and comprises an at least partially transparent material such that light is able to pass through it. As seen by the light rays in FIG. 1*b*, the light control layer refracts the light incident to, and reflected from, the colour shifting element 10. More specifically the red to green colour shift is observed at angles closer to a normal angle of viewing. Furthermore, due to the smaller difference in refractive index between the colour shifting element 10 and the light control layer 20 than between the colour shifting element 10 and the air, and the angled facets of the light control layer, blue light is no longer totally internally reflected by the light control layer and is instead observable to the viewer, as shown schematically in FIG. 1*b* at the light ray labelled B. The presence of light control layer 20 as seen in FIG. 1*b* therefore exhibits a red to green to blue colour shift effect to the viewer upon tilting, and this effect is observable closer to normal angles of viewing as compared to the colour shifting element 10 in isolation.

The light modification properties of the light control layer are most noticeable when the device is viewed in a direction perpendicular to the long axes of the microprisms of the light control layer, and tilted about an axis substantially parallel to the long axes of the microprisms.

Figure 2A:
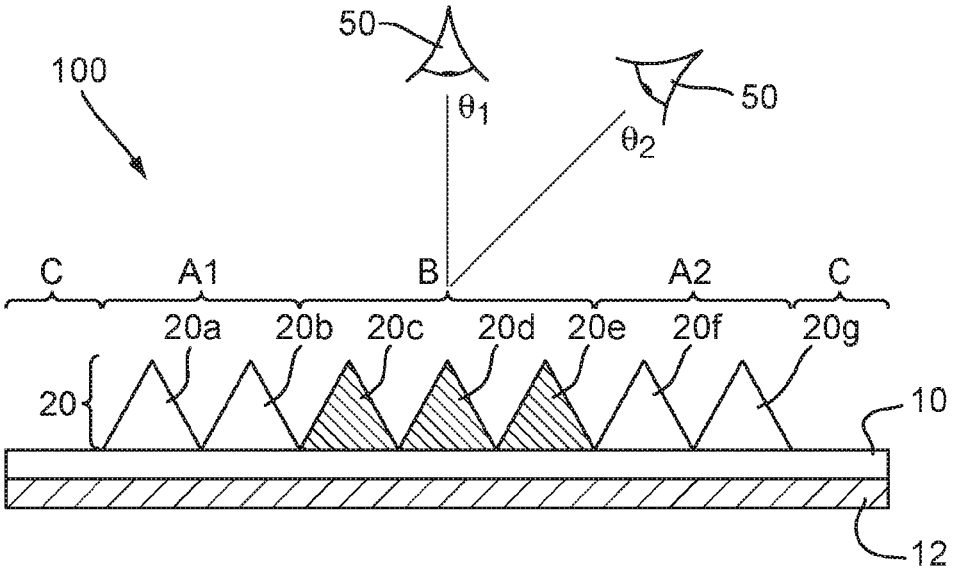
FIGS. 2*a* and 2*b* illustrate a security device according to an exemplary embodiment of the invention.

FIG. 2*a* is a cross-sectional view of a security device 100 according to a first example embodiment of the invention. The device 100 comprises a colour shifting element 10 partially covered by a light control layer 20. The colour shifting element 10 in this case is a liquid crystal element exhibiting a red to green colour shift upon tilting (i.e. a change in viewing angle from $\Theta$1 to $\Theta$2). The liquid crystal is partially transparent and as the device 100 is intended to be viewed in reflection an absorbing layer 12 is used to absorb light transmitted through the colour shifting element.

Figure 2B:
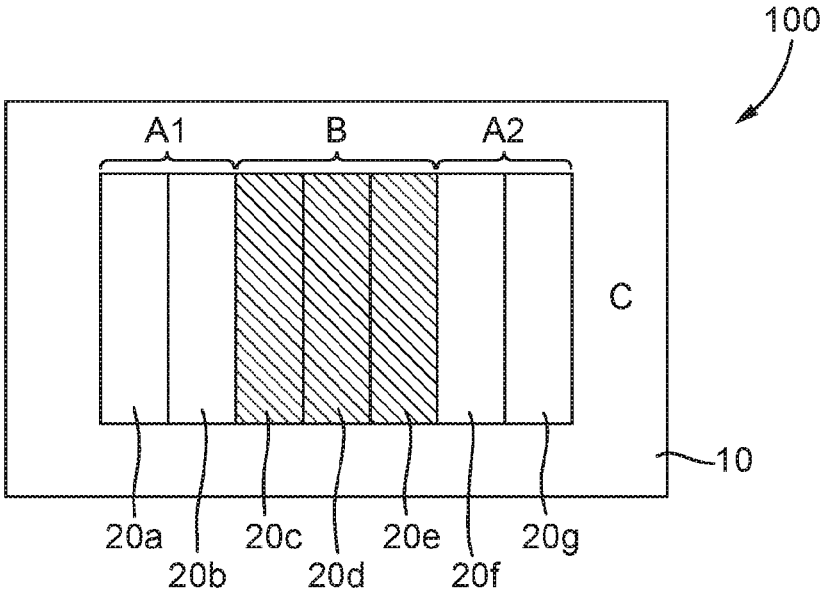

The light control layer 20 comprises a plurality of linear microprisms 20*a*, 20*b*, 20*c*, 20*d*, 20*e*, 20*f*, 20*g* defining a surface relief as described in FIGS. 1*a* and 1*b*. Microprisms 20*a*, 20*b*, 20*f* and 20*g* are substantially colourless, and define functional regions A1 and A2. Microprisms 20*c*, 20*d* and 20*e* each comprise a first optical characteristic and exhibit a yellow tint. Microprisms 20*c*, 20*d* and 20*e* define functional region B and are at least partially transparent such that visible light from the colour shifting element 10 can pass through them. The region of the colour shifting element not covered by the light control layer 20 is labelled as region C. FIG. 2*b* illustrates the arrangement of device 100 in plan view.

The visual effect exhibited by the device 100 will be explained with reference to two viewing angles $\Theta$1 and $\Theta$2, shown in FIG. 2*a*. Viewing angle $\Theta$1 is a substantially normal angle of viewing, and in isolation the colour shifting element 10 would exhibit a red colour. Viewing angle $\Theta$2 is an off-normal angle of view (or equivalent tilt of the device with the viewer remaining stationary). In isolation, the colour shifting element 10 would exhibit a green colour at viewing angle $\Theta$2.

Figure 3A:
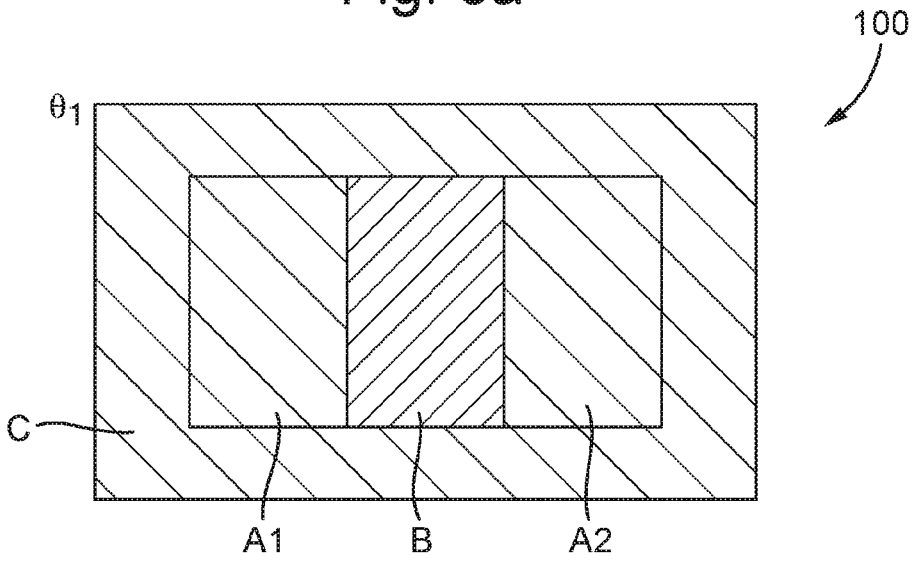
FIGS. 3*a* and 3*b* illustrate the visual effect exhibited by a security device according to an exemplary embodiment of the invention.

The visual effect exhibited to a viewer by the device 100 at viewing angle $\Theta$1 is schematically illustrated in FIG. 3*a*. At angle $\Theta$1, the colour shifting element exhibits a red colour. Therefore, due to the colourless nature of the microprisms in regions A1 and A2, regions A1, A2 and C all exhibit a red colour. At normal viewing angle $\Theta$1, the effect of the surface relief of the light control layer 20 on the exhibited colour is minimal. However, due to the yellow tint of region B, red light from the colour shifting element additively mixes with the yellow of the microprisms in region B to give a resultant orange colour. The device 100 therefore exhibits an orange region (B) surrounded by red colour when viewed at normal incidence. This is schematically illustrated in FIG. 3*a* by different shading.

On tilting the device (i.e. viewing at viewing angle $\Theta$2), region C will exhibit a green colour as a result of the green colour exhibited by the colour shifting element 10. However, as explained above with reference to FIG. 1*b*, the microprisms 20*a*, 20*b*, 20*f*, 20*g* of regions A1 and A2 mean that blue light from the colour shifting element that would normally be totally internally reflected (as in region C) is now exhibited in regions A1 and A2, such that regions A1 and A2 appear blue. Moreover, region B now appear turquoise due to a combination of blue light due to the effect of the colour shifting element and the surface relief of the light control layer, and the yellow tint. Therefore, the resulting effect at viewing angle Θ2 is that regions A1 and A2 appear blue, region B appears turquoise and region C appears green. This is schematically shown in FIG. 3*c* through different shading. It should be noted that the different shadings do not correspond to certain colours or surface relief orientation, and are only used to differentiate regions of different colour.

Moreover, it will be appreciated that throughout the figures the number of microprisms in each region is for illustrative purposes only, and in reality the number of microprisms or other structures within a region will be greater than shown herein.

As can be appreciated, there is a striking visual effect exhibited to a viewer upon tilting the device due to the changes in colour. A particularly interesting effect is that regions A1, A2 and C would not be distinguishable at normal viewing, but exhibit different colours on tilting the device. Such an effect would be particularly effective if at least one of regions A1 and A2 defined indicia (such as a digit, letter, geometric shape, symbol, image, graphic or alphanumerical text). Such indicia would then only be revealed upon tilting of the device from a normal angle of viewing to a more acute angle.

In the example described above, the microprisms of regions A1 and A2 were substantially colourless such that the light from the colour shifting element was viewable through said prisms without any substantive change in colour. However, the microprisms of regions A1 and A2 may comprise an optical characteristic such that they exhibit a coloured tint. For example, the microprisms of regions A1 and A2 may exhibit a red tint. In such a case, at viewing angle Θ1, regions A1 and A2 will appear dark red. However, upon tilting the device, regions A1 and A2 will exhibit a purple colour due to the combination of blue light and red light. Of course, the microprisms of regions A1 and A2 may comprise different optical characteristics such that they exhibit different coloured tints (or one region being substantially colourless and the other region having a coloured tint).

Figure 3B:
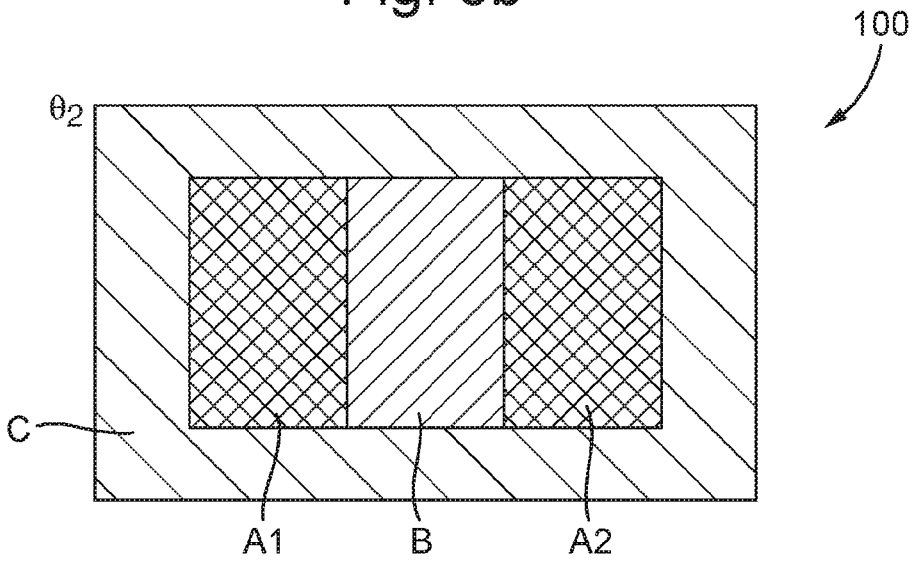
Figure 4:
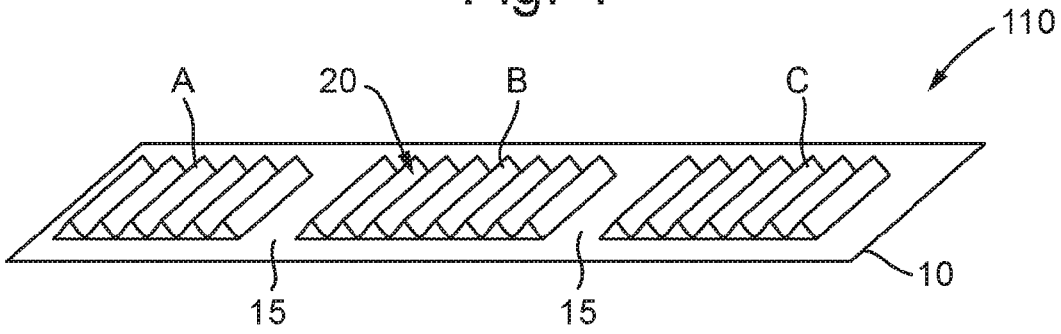
FIG. 4 illustrates a further example security device of the invention.

In the examples shown in FIGS. 3*a* and 3*b*, the different functional regions of the light control layer are shown substantially abutting one another. However, it is envisaged that the light control layer may, alternatively or in addition, comprise two or more regions that are spaced apart, as illustrated in FIG. 4. Specifically, FIG. 4 illustrates an example security device 110 comprising a colour shifting element 10 and a light control layer 20 comprising three regions (labelled at A, B and C). Each region comprises an array of linear microprisms, and the regions are separated along a direction perpendicular to the long axes of the microprisms by gap regions 15. The gap regions 15 may comprise an exposed region of colour shifting element, or alternatively may comprise a "non-functional" region of material (i.e. having a planar surface substantially parallel with the colour shifting element, rather than a surface relief as in the functional regions A, B, C) such that the angle of light from the colour shifting element in the gap regions is not substantially modified. In the case where the functional regions are spaced apart, the functional regions are still considered to be a part of the same light control layer.

Figure 5A:
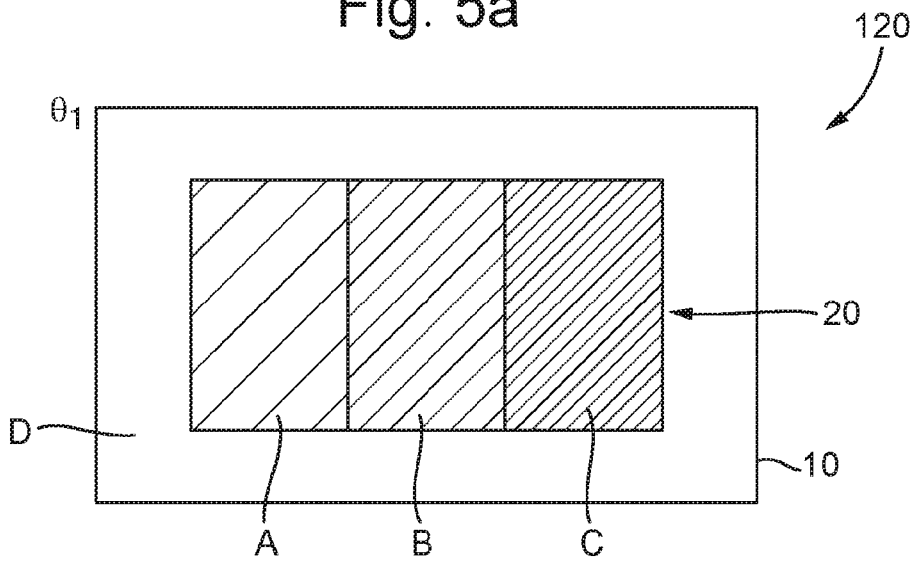
FIGS. 5*a* and 5*b* illustrate the visual effect exhibited by a security device according to an embodiment of the invention.

FIG. 5*a* illustrates, in plan view, an example security device 120 comprising a colour shifting element 10 a light control layer 20 comprising an array of linear microprisms defining three functional regions (here A, B and C) in the same manner as in FIGS. 2 and 3. In this case, the microprisms of each functional region have an optical characteristic such that they absorb substantially the same wavelengths of light (and therefore exhibit the same colour); however, a level of light absorption level of each region differs such that a transparency level of each region differs. For example, as illustrated by the shading, region A is the most transparent to visible light, and region C is the least transparent to visible light. Therefore, the amount of light from the colour shifting element reaching the viewer through the microprisms of each region varies, giving a different resultant colour exhibited by each region.

In this example, suppose the colour shifting element exhibits infrared (IR) light at a normal angle of viewing Θ1 (i.e. appears black) and exhibits red light upon tilting and viewing at a viewing angle Θ2, and each functional region of the light control layer 20 exhibits a blue tint but with the transparency of region A being greater than region B and the transparency of region B being greater than that of region C. At a normal angle of viewing Θ1, as shown in FIG. 5*a*, region D of the device will appear black, region A will exhibit a dark blue colour, region B will exhibit a lighter blue colour, and region C will exhibit an again lighter blue colour.

Figure 5B:
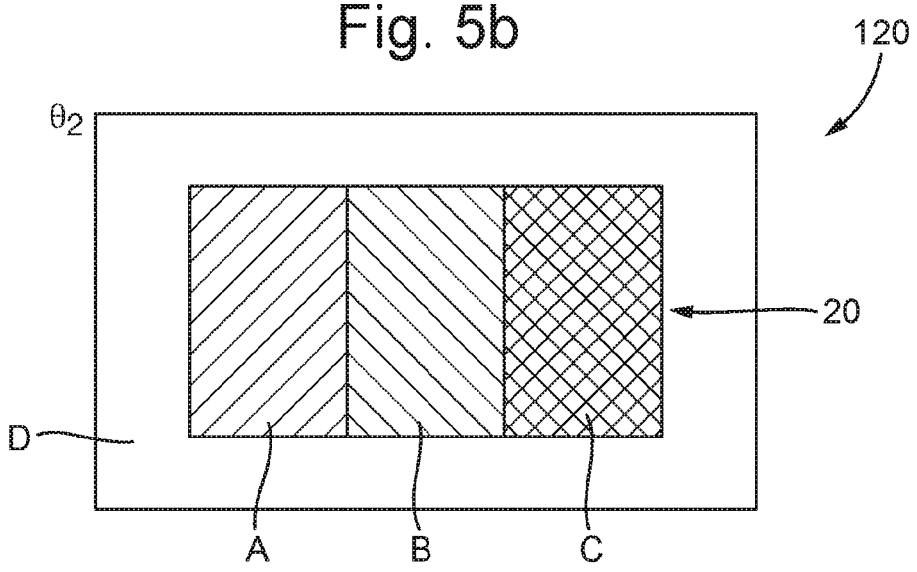

The effect of tilting the device and viewing at Θ2 is schematically illustrated at FIG. 5*b*, where different shading patterns of the functional regions A, B and C indicate different exhibited colours. The functional regions A, B and C of the device will all exhibit colours resultant from a combination of red light from the colour shifting element and blue light from the tinted microprisms. However, the combinations will have different ratios due to the different levels of transparency of the microprisms in each region. Specifically, functional region A will exhibit a maroon colour, functional region B will exhibit a purple colour and functional region C will exhibit an indigo colour. In other words, the ratio of blue to red in the resultant colour increases from region A to C as the transparency of the microprisms decreases. Region D (i.e. the exposed colour shifting element) appears red at viewing angle Θ2.

Figure 6A:
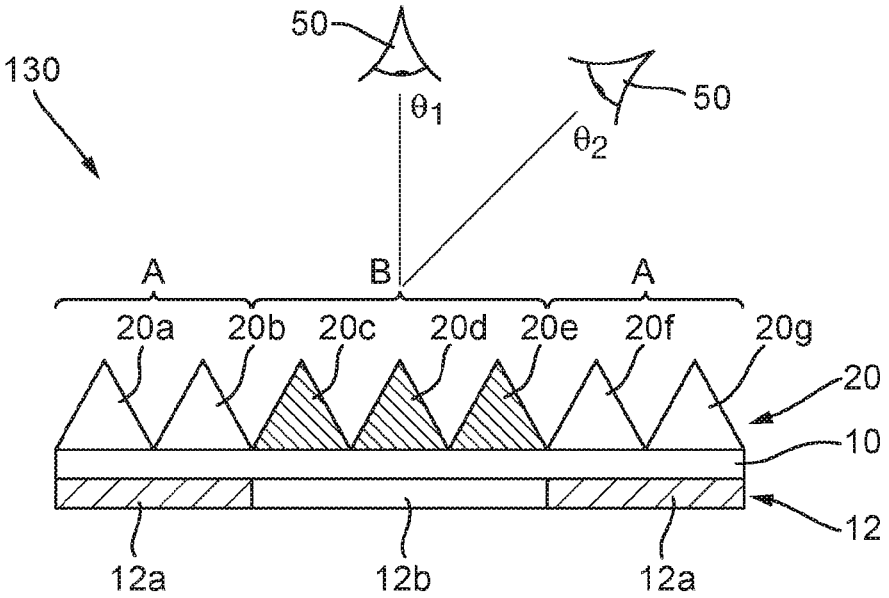
FIGS. 6*a* and 6*b* illustrate a further exemplary security device according to the invention and its associated visual effect.
Figure 6B:
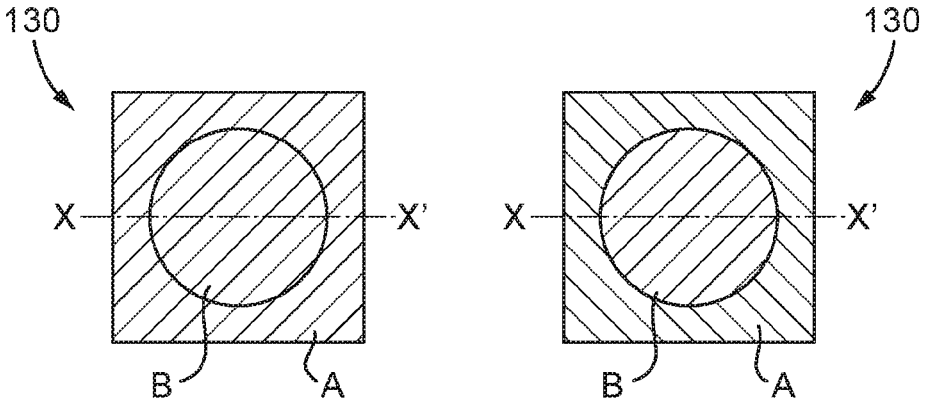

In the case where the colour shifting element is at least partially transparent (such as a cholesteric liquid crystal layer), the absorbing layer 12 may be advantageously patterned so as to define indicia. This effect is illustrated in FIGS. 6*a* and 6*b*, which show a security device 130 according to an example embodiment of the invention. FIG. 6*b* shows the device in plan view and FIG. 6*a* illustrates the device in cross section along X-X'. Here, the absorbing layer is patterned so as to define a circular region B, defined by a gap region 12*b* in the absorbing layer, surrounded by dark light-absorbing material 12*a*. In this example, the colour shifting element comprises a cholesteric liquid crystal layer that exhibits a red to green colour shift. Microprisms 20*a*, 20*b*, 20*f* and 20*g* of the light control layer that fully overlap with the dark region 12*a* of the absorbing layer 12 (corresponding to region A) are all substantially colourless, and microprisms 20*c*, 20*d*, 20*e* that fully overlap with gap region 12*b* (corresponding to region B) exhibit a red tint.

As illustrated in FIG. 6*b*, at normal viewing Θ1, both regions A and B exhibit a red colour, and are not substantially discernible from each other. Region A exhibits a red colour due to the red colour from the colour shifting element at Θ1 10 being visible in reflection through the colourless microprisms. The red colour of region B is exhibited due to the red tint of the microprisms in region B. However, upon tilting of the device, the colour shifting element exhibits a blue colour in combination with the surface relief of the light control layer. This is viewable in reflection through the colourless microprisms of region A. However, due to the gap region 12*b* in absorbing layer 12, this effect of the colour shifting element is not visible in reflection, and therefore region A remains red. This change in colour upon tilting creates a striking effect to a viewer.

Figure 7:
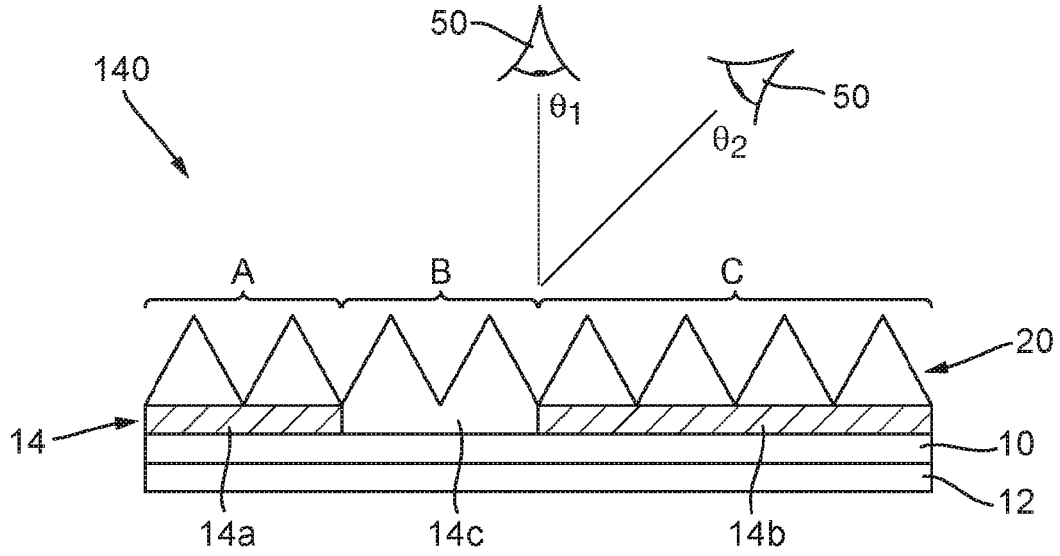
FIGS. 7 and 8 illustrate further security devices according to exemplary embodiments of the invention.

In the above embodiments, the microprismatic structures of the light control layer comprise an optical characteristic that makes them appear to have a coloured tint. However, as schematically illustrated in FIG. 7, a security device 140 according to the invention may comprise an at least partially transparent coloured layer (which will be referred to as a "tinted coloured layer" for ease of description) positioned between the colour shifting element and the light control layer. FIG. 7 illustrates a device 140 comprising a colour shifting element 10, a light control layer 20 and a tinted coloured layer 14 comprising two regions 14*a*, 14*b* positioned between the colour shifting element and the light control layer. The regions 14*a*, 14*b* are laterally spaced apart so as to define a gap region in the tinted colour layer shown at 14*c*. As in the previous examples described above, the light control layer 20 comprises an array of linear microprisms. In the example seen in FIG. 7, the colour shifting element is partially transparent and so an absorbing layer 12 is used such that the device is intended to be viewed in reflection. However, with the tinted coloured layer 14 positioned between the colour shifting element and the light control layer, a substantially opaque colour shifting element may alternatively be used without the requirement for an absorbing layer. In this example, the microprisms of the light control layer are substantially transparent and colourless.

Each of the regions 14*a*, 14*b* is at least partially transparent, meaning that light from the colour shifting layer is able to pass through. The regions may exhibit the same colour, or may exhibit different colours and/or transparency levels. For ease of description, let us suppose that both regions 14*a* and 14*b* have the same optical characteristic such that they exhibit the same yellow colour at all viewing angles, and have the same transparency level. Let us also suppose that the colour shifting element 10 exhibits a red to green colour shift upon tilting, which is modified to a red to green to blue colour shift due to the presence of the light control layer in device 140. Therefore, at a normal angle of viewing Θ1, region A will exhibit an orange colour (resultant of red and yellow light), region B will exhibit a red colour (visible through gap region 16) and region C will exhibit an orange colour in the same manner as region A. However, upon tilting of the device and viewing at an angle Θ2, regions A and C will exhibit a turquoise colour (a resultant of blue and yellow light), and region B will exhibit a blue colour. Typically, this difference in exhibited appearance of the device at regions A, B and C is utilised such that the device exhibits indicia defined by the different coloured regions, with the form (i.e. shape) of the indicia defined by the tinted coloured layer.

Figure 8:
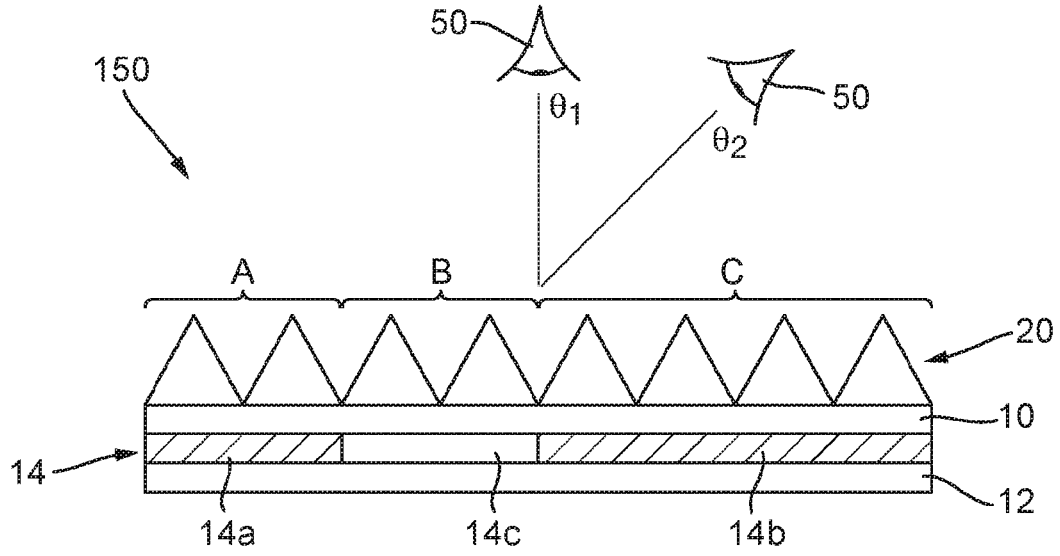

FIG. 8 illustrates an alternative embodiment where the tinted coloured layer 14 is positioned between the colour shifting element 10 and the absorbing layer 12. In this case the colour shifting element 10 is at least partially transparent, meaning that light from the tinted coloured layer 14 is transmitted through the colour shifting element. The lateral arrangement of the regions 14*a*, 14*b* of the tinted coloured layer 14 is the same as that seen in FIG. 7, and so the overall effect exhibited to a viewer of both devices 140 and 150 is the same (as shown in FIGS. 9*a* and 9*b*).

Figure 9A:
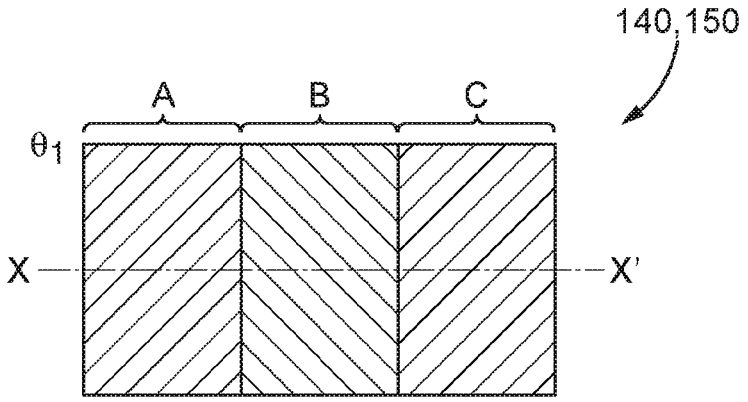
FIGS. 9*a* and 9*b* illustrates the associated visual effect.
Figure 9B:
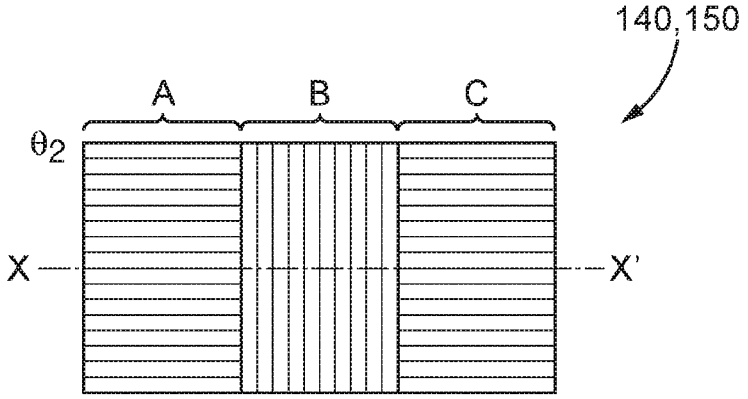

FIG. 9*a* illustrates, in plan view, the overall effect exhibited by either device 140 and 150 when viewed at viewing angle Θ1 (FIGS. 7 and 8 are cross sections taken along X-X'). The different shading patterns highlight the orange colour exhibited by regions A and C, and the different red colour exhibited by region B. FIG. 9*b* illustrates the overall impression of the device 140, 150 when viewed at viewing angle Θ2. Here, the difference in shading represents the change in colour of the regions on tilting the device, and the difference in the colour of regions A, B and C. As explained above, at viewing angle Θ2, regions A and C exhibit a turquoise colour and region B exhibits a blue colour.

Here, the tinted coloured layer has been provided to define simple indicia, for example suitable colours could be used to exhibit a national flag. However, it will be appreciated that more complex indicia such as alphanumeric text or images can be generated through the provision of a coloured layer in a suitable form.

Figure 31:
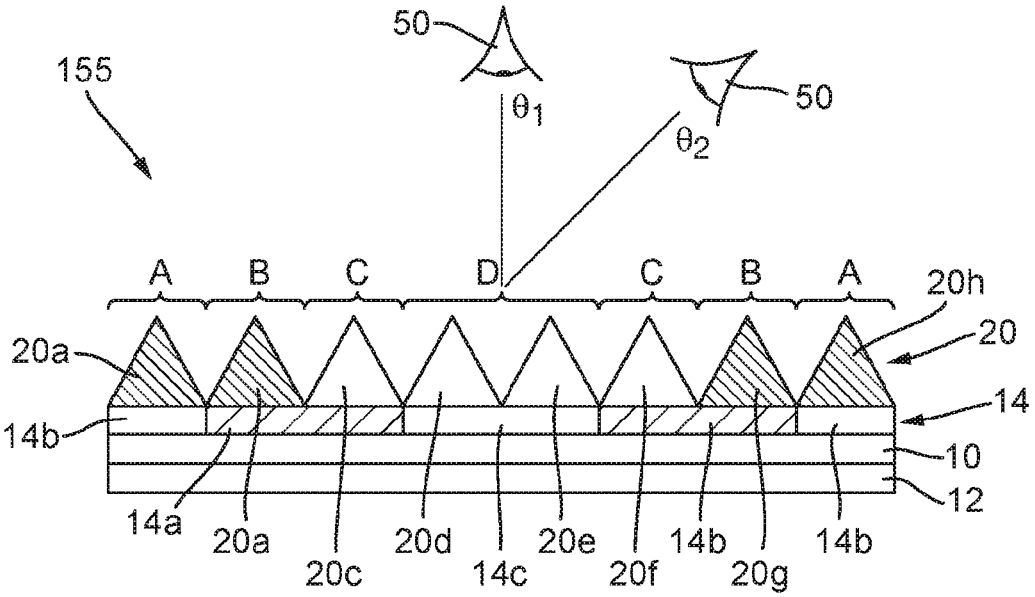
FIG. 31 illustrates a further security device according to an exemplary embodiment of the invention.

Furthermore, in the embodiments described in FIGS. 7-9, the light control layer is substantially transparent and colourless such that the resultant colour exhibited to a viewer from a region of the device is the resultant of the colour shifting element and the presence (or not) of a coloured layer. It will be appreciated that at least one (typically a region of) microprism(s) of the light control layer may comprise an optical characteristic such that it exhibits a coloured tint. The combination of a colour shifting element, tinted coloured layer and an at least partially coloured light control layer may lead to further interesting coloured effects exhibited by the device, and can provide improved control over the final resultant colours that are exhibited to a viewer. An example is illustrated in FIG. 31, which illustrates exemplary security device 155.

The structure of device 155 is similar to that of device 140 seen in FIG. 7. Device 155 comprises a colour shifting element 10, a light control layer 20 and a tinted coloured layer 14 comprising two regions 14*a*, 14*b* positioned between the colour shifting element and the light control layer. The regions 14*a*, 14*b* are laterally spaced apart so as to define gap regions (or "non-functional" regions) 14*b* and 14*c* in the tinted colour layer. In the example seen in FIG. 31, the colour shifting element is partially transparent and so an absorbing layer 12 is used such that the device is intended to be viewed in reflection. However, with the tinted coloured layer 14 positioned between the colour shifting element and the light control layer, a substantially opaque colour shifting element may alternatively be used without the requirement for an absorbing layer.

In this example, the partially transparent tinted coloured layer has a yellow tint, and microprisms 20*a*, 20*b*, 20*g* and 20*h* also have an optical absorption characteristic such that they exhibit a yellow tint. Microprisms 20*c*, 20*d*, 20*e* and 20*f* are substantially colourless. The colour shifting element 10 is a red to green colour shifting element in that in isolation it exhibits a red colour for normal viewing and a green colour on tilting. Therefore, at normal viewing Θ1 of the device 155, region A of the device appears red-orange due to a combination of the red colour from the colour shifting element and the yellow tint of the microprisms 20*a*, 20*h*; region B appears yellow-orange due to the combination of the red colour from the colour shifting element and the yellow tint from both the layer 14 and microprisms 20*b*, 20*g*; region C appears red-orange due to a combination of the red colour from the colour shifting element and the yellow tint of the layer 14, and region D appears red as no yellow tint is present in region D.

Upon tilting of the device and viewing from viewing angle Θ2, region A will appear blue-green as a result of the blue colour exhibited by the combination of the colour shifting layer and the surface relief of the light control layer, and the yellow tint of the microprisms 20*a*, 20*h*; region B will appear yellow-green as a result of the blue colour exhibited by the combination of the colour shifting layer and the surface relief of the light control layer, and the yellow tint of both the light control layer and microprisms 20*b*, 20*g*; region C will appear blue-green as a result of the blue colour exhibited by the combination of the colour shifting layer and the surface relief of the light control layer, and the yellow tint of the layer 14; and region D will appear blue.

In this example, both the tinted coloured layer 14 and the tinted microprisms have the same colour tint. However, in other embodiments, the tinted coloured layer and tinted microprisms may have different colours of tint.

Figure 10A:
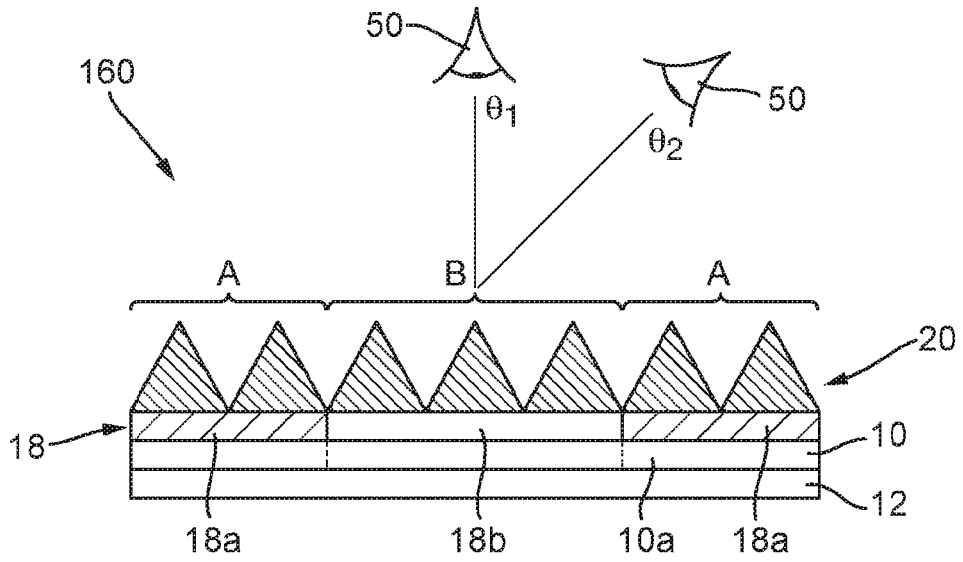
FIGS. 10*a* and 10*b* illustrate an exemplary security device according to the invention and its associated visual effect.
Figure 10B:
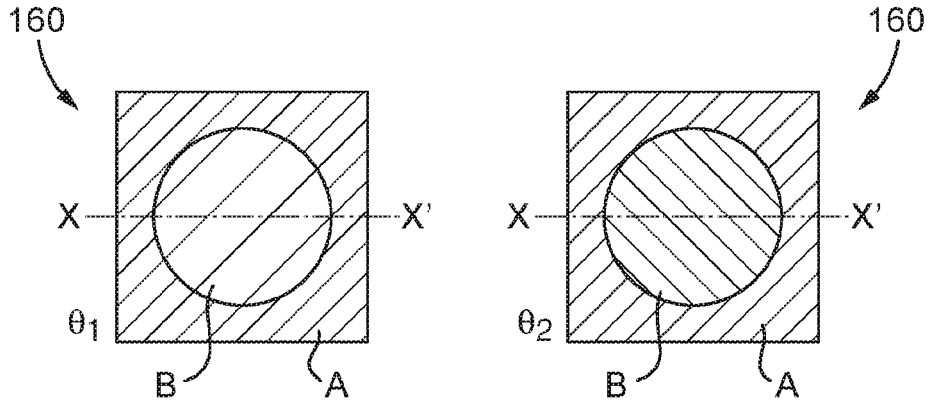

FIGS. 10*a* and 10*b* illustrate a security device 160 according to a further exemplary embodiment of the present invention. FIG. 10*b* shows the device 160 in plan view at two different viewing angles Θ1 and Θ2, and FIG. 10*a* shows the device in cross-section along X-X'. Considering first FIG. 10*a*, the security device 160 comprises a colour shifting element 10, an absorbing layer 12, a light control layer 20 comprising an array of linear microprisms as described in the previous embodiments, and a substantially opaque coloured layer 18 ("opaque coloured layer"). The opaque coloured layer 18 is provided so as to only partially cover the colour shifting element 10 (shown at 18*a*), defining indicia in the form of a circular region B (see FIG. 10*b*) where light from the colour shifting element 10 is able to pass through a gap region 18*b* in the opaque coloured layer. Here, "substantially opaque" means that, where the opaque coloured layer overlaps with the colour shifting element, light from the covered regions of the colour shifting element (10*a*) is not transmitted through the opaque layer. Where the opaque coloured layer overlaps with the colour shifting element defines region A of the device.

In the present example a partially transparent colour shifting element is used and a corresponding absorbing layer is provided such that the device is intended to be viewed in reflection. However, it will be appreciated that a substantially opaque colour shifting element could alternatively be used.

In the present example, each of the microprisms of the light control layer has the same optical characteristic such that they each exhibit a red tint. The substantially opaque coloured layer exhibits a red colour at substantially all viewing angles, and the colour shifting element exhibits a red to green colour shift, modified to a red to green to blue colour shift due to the presence of the surface relief of the light control layer.

At a normal angle of incidence (Θ1), region B of the device exhibits a red colour due to the resultant of the red colour exhibited by the colour shifting element and the red tint of the light control layer. Region A of the device exhibits a dark red colour due to the resultant of the red colour exhibited by the opaque coloured region and the red tint of the light control layer. Region A appears darker than region B due to the greater opacity of the coloured layer 18 as compared to the colour shifting element 10. Even so, the circle at region B is not easily discernible to a viewer at a normal angle of viewing Θ1. (It is envisaged that the colour of the opaque layer 18 may be determined such that the exhibited colour effects of the different regions substantially match at least at one angle of view.) This difference is illustrated in the different density of hatching in regions A and B in FIG. 10*b*.

Upon tilting the device 160 and viewing at viewing angle Θ2, region A will remain substantially the same colour (as the variable colour effect from the colour shifting device is "blocked" by the opaque coloured layer). However, light from the colour shifting element 10 is able to pass through gap region 18*b* in the opaque coloured layer and therefore a colour change is exhibited in region B. Specifically, at a viewing angle Θ2, region B appears purple against a dark red background (region A). The purple colour derives from the resultant of blue light from a combination of the colour shifting element and the surface relief of the light control layer, and the red tint of the light control layer. This colour difference is schematically represented by the different shading in FIG. 10*b*.

Therefore, region B becomes more easily discernible to a viewer upon tilting the device, providing a striking optical effect to a viewer.

In the above example described with reference to FIGS. 10*a* and 10*b*, the substantially opaque coloured layer exhibits a red colour at substantially all viewing angles, and the region B becomes more easily discernible to a viewer upon tilting the device. A similarly striking effect can be provided if the substantially opaque coloured layer exhibits a blue colour instead, as the region B would be discernible against region A at normal viewing (Θ1), but would "disappear" upon tilting and viewing at Θ2. In such an instance, at Θ1, region A would appear red against a purple background, whereas at Θ2 both region A and region B would exhibit a purple colour as the blue colour of the opaque layer matches the blue colour exhibited due to the combination of the colour shifting element and light control layer at Θ2.

More complex effects may be generated by providing tinted and non-tinted regions of the light control layer overlapping with a same region of the opaque layer, as will be explained below with reference to FIGS. 11*a* and 11*b*.

Figure 11A:
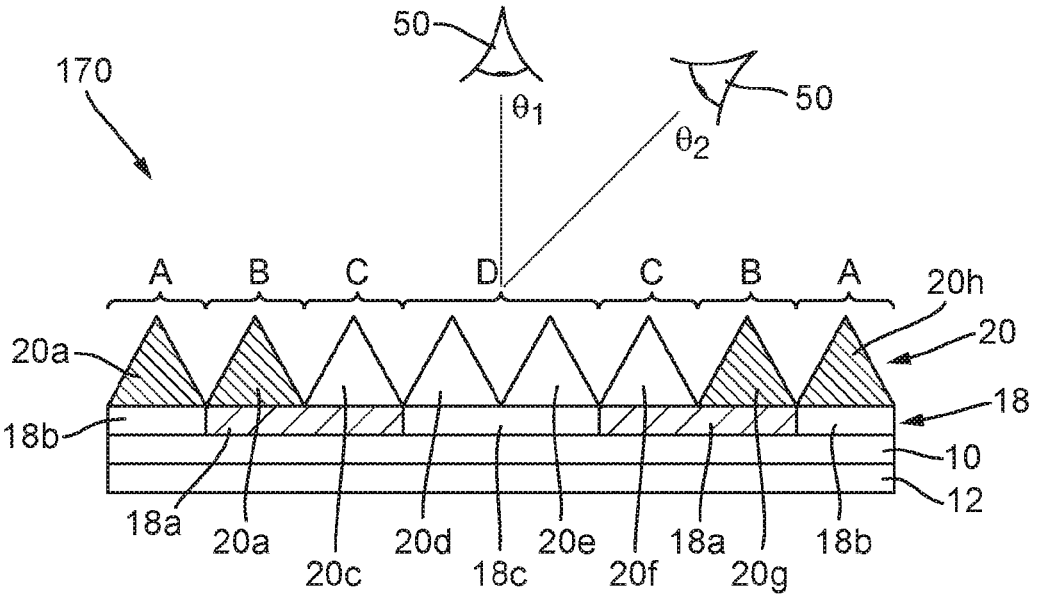
FIGS. 11*a* and 11*b* illustrate an exemplary security device according to the invention and its associated visual effect.
Figure 11B:
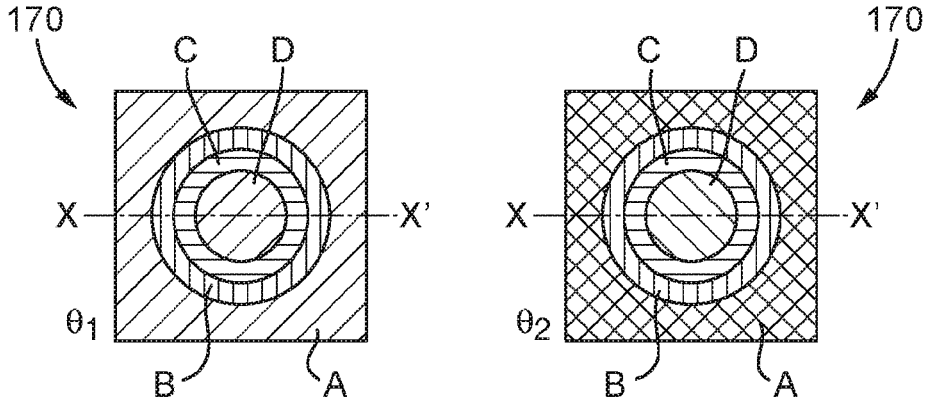

FIGS. 11*a* and 11*b* illustrate a security device 170 according to a further exemplary embodiment of the invention, with a similar structure to device 155 seen in FIG. 31. FIG. 11*b* shows the device 170 in plan view at two different viewing angles Θ1 and Θ2, and FIG. 11*a* shows the device in cross-section along X-X'. Considering first FIG. 11*a*, the security device 170 comprises a colour shifting element 10, an absorbing layer 12, a light control layer 20 comprising an array of linear microprisms 20*a*, . . . 20*h* as described in the previous embodiments, and a substantially opaque coloured layer 18. The opaque coloured layer is provided to only partially cover the colour shifting element (illustrated at shaded regions 18*a*, and gap regions 18*b* and 18*c*), and is provided in an annular manner (at regions B and C in FIG. 10*b*) so as to define an inner circular region D and a region A defined outside of the annular regions B and C. The term "opaque" has the same meaning as above.

In the present example a partially transparent colour shifting element is used and a corresponding absorbing layer is provided such that the device is intended to be viewed in reflection. However, it will be appreciated that a substantially opaque colour shifting element could alternatively be used.

Only some of the linear microprisms of the light control layer 20 are tinted in the present example. Specifically, microprisms 20*a* and 20*h* (in region A), and microprisms 20*b* and 20*g* (in region B) have an optical characteristic such that they exhibit a coloured (in this case red) tint. The remainder of the microprisms are substantially transparent and colourless. As tinted prism 20*b* and colourless prism 20*c* both overlap with opaque coloured region 18*a* (and similarly with microprisms 20*f* and 20*g*), the annular region defined by the opaque coloured layer is split into two annular regions B and C due to the difference in resultant colour exhibited by these regions. The device can therefore be seen to exhibit four coloured regions A, B, C and D as shown in FIG. 10*b*.

Suppose that the opaque coloured layer exhibits a yellow colour at substantially all viewing angles and that the colour shifting element, in combination with the surface relief of the light control layer, exhibits a red to blue colour shift, then we can consider the resultant colours exhibited by the device 170. At a normal angle of viewing Θ1, region A will exhibit a dark red colour, region B will exhibit an orange colour, region C will exhibit a yellow colour and region D will exhibit a red colour (slightly discernible from the dark red of region A). Upon tilting and viewing the device at viewing angle Θ2, regions B and C will remain substantially the same colour due to the presence of the substantially opaque layer. However, regions A and D will exhibit a colour shift as light from the colour shifting element is able to pass through gap regions 18*b* and 18*c* in the opaque coloured layer. Therefore, at viewing angle Θ2, region D will appear blue and region A will appear purple (resultant of red and blue light). The different shadings in FIG. 10*b* schematically illustrate these colour differences and changes.

Figure 12:
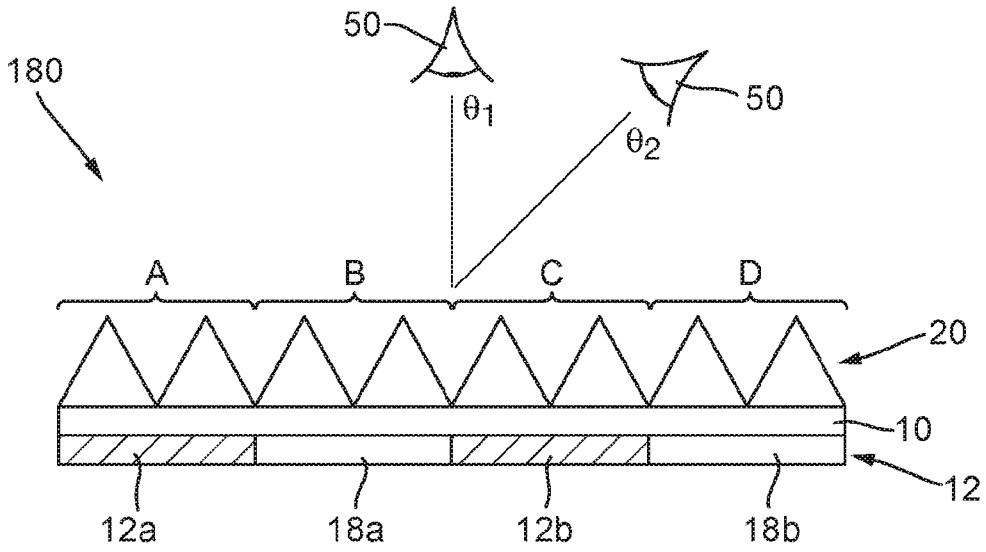
FIG. 12 illustrates a further exemplary security device according to the invention.

FIG. 12 illustrates a security device 180 according to a further embodiment of the invention. The security device 180 comprises a light control layer 20 comprising a plurality of linear microprisms as described above, a partially transparent colour shifting element 10, and an absorbing layer 12. The device is intended to be viewed in reflection. Similarly to device 130 described in FIG. 6*a*, the absorbing layer 12 is patterned (typically to define indicia), and this is shown by regions 12*a* and 12*b*. However, instead of corresponding gap regions in the absorbing layer 12, the absorbing layer comprises substantially opaque coloured regions 18*a* and 18*b*. (Although this embodiment illustrates two opaque coloured regions, it will be appreciated that only one opaque coloured region may be used.)

Due to the partially transparent nature of the colour shifting element 10, light from the opaque coloured regions is able to pass through the colour shifting element, thereby meaning that the resultant colour exhibited to a viewer is affected by the opaque coloured regions.

Suppose that the colour shifting element and the surface relief of the light control layer combine to exhibit a red to blue colour shift, that each of the microprisms of the light control layer is substantially transparent and colourless, and that regions 18*a* and 18*b* exhibit red and yellow colours respectively at all viewing angles. Therefore, at a normal angle of viewing Θ1, regions A and C will exhibit a red colour, region B will exhibit dark red and region D will exhibit orange. Upon tilting of the device and viewing at viewing angle Θ2, regions A and C will exhibit a blue colour, region B will exhibit purple (a resultant of red and blue light) and region D will appear turquoise.

In order to manufacture a security device according to the invention, each of the required layers of the absorbing layer, tinted coloured layer, opaque coloured layer and colour shifting element are first laid down on a suitable polymeric carrier substrate, such as a PET or BOPP foil, or polycarbonate. Here, all printing methods that are suitable for application of the various layers may be used, such as intaglio printing, gravure, flexo printing, inkjet printing, knife coating, curtain or blade techniques. Subsequently the light control layer is applied, as will be described below with reference to FIGS. 13 and 14.

In other embodiments, the substrate itself may form the tinted coloured layer or opaque coloured layer as described above; for example tinted polycarbonate could be used as a substrate, or a deep-dyed PET or BOPP film such as from CPFilms Inc, a subsidiary of Eastman Chemical Company. Typical substrate thicknesses are in the range of 10-200 microns, more preferably 15-100 microns and even more preferably 15-40 microns. For example the security device may be incorporated into a thread for a polymer banknote, where the polymer banknote may typically have a thickness of about 75 microns.

For ease of description, we will consider the manufacture of device 100 (illustrated in FIG. 2*a*). Firstly, the absorbing layer and colour shifting element are provided on a suitable polymeric carrier substrate to form device substrate 100*a*. In one embodiment, shown in FIG. 13, a first radiation-curable material (corresponding to region A2 of the device) is applied to the outer surface of a substantially cylindrical casting cylinder 300 by first applicator 331. The outer surface of the casting cylinder carries the inverse surface relief of the desired surface relief of the light control layer. Excess material may be removed by doctor blade 335. A second radiation-curable material (corresponding to region B) having a first optical characteristic is applied to the outer surface of the casting cylinder by second applicator 332, and again any excess may be removed by doctor blade 336.

The device substrate 100*a* is then introduced to a nip 315 defined between the casting cylinder 310 and first impression roller 320, such that the material on the casting cylinder is transferred to the device substrate 100*a*. Having been formed into the correct surface relief structure, the curable material is cured by exposing it to appropriate curing energy such as radiation R from a source 350. This preferably takes place while the curable material is in contact with the surface relief of the casting cylinder although if the material is already sufficiently viscous this could be performed after separation. In the example shown, the material is irradiated through the device substrate 100*a*, although the source 350 could alternatively be positioned above the device substrate 100*a*, e.g. inside cylinder 310 if the cylinder is formed from a suitable transparent material such as quartz.

The device substrate, now comprising the cured light control layer material, passes through second nip 316 defined by second impression roller 330, and the light control layer, now affixed to the colour shifting element of the device, separates from the casting cylinder such that device 100 is formed. It will be appreciated that an appropriate registering of the applicators 331, 332, and the provision of the device substrate 100*a* is required in order to provide the desired regions A1, A2 and B of the light control layer. It will also be appreciated that in embodiments where a uniform light control layer is provided (e.g. all colourless or all tinted), only one applicator is required.

Figure 14:
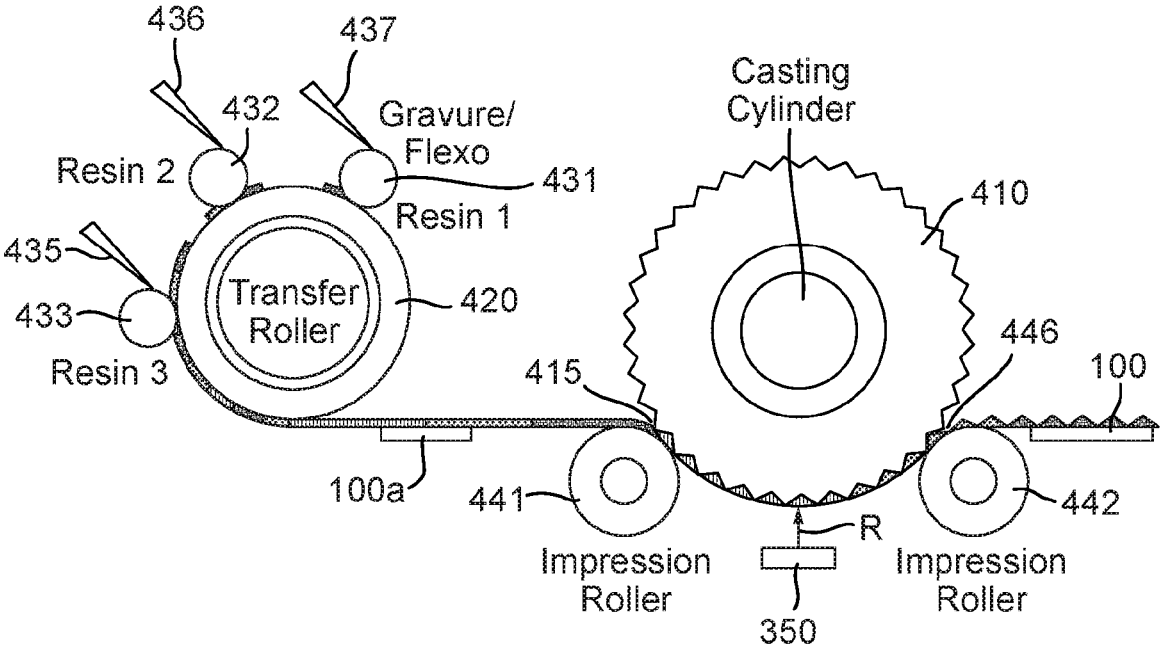

FIG. 14 illustrates a further example of manufacturing such a security device, and illustrates how the light control layer may comprise three different materials (for example having differing optical characteristics such as differing optical absorption characteristics). Here, device substrate 100*a* is provided to a transfer roller 420, where first, second and third suitable curable materials are provided, in appropriate register, by first, second and third applicators 431, 432, 433. Doctor blades (illustrated at 435, 436 and 437) may be used to remove excess material. The device substrate 100*a*, now comprising the curable material, is subsequently introduced to casting cylinder 410, wherein the outer surface of the casting cylinder comprises the inverse surface relief of the desired light control layer surface relief.

The device substrate 100*a* passes through first nip 415 defined by impression roller 441 and casting cylinder to form the surface relief of the light control layer in the curable material, wherein subsequently the curable material is cured by radiation R in the same manner as described above in relation to FIG. 13. This preferably takes place while the curable material is in contact with the surface relief of the casting cylinder, although if the material is already sufficiently viscous this could be performed after separation. In the example shown, the material is irradiated through the device substrate 100*a*, although the source 450 could alternatively be positioned above the device substrate 100*a*, e.g. inside cylinder 410 if the cylinder is formed from a suitable transparent material such as quartz.

The device substrate, now comprising the cured light control layer material, passes through second nip 416 defined by second impression roller 442, and the light control layer, now affixed to the colour shifting element of the device, separates from the casting cylinder such that device 100 is formed.

In both examples described above, the different curable materials of the light control layer are cured substantially simultaneously. However, it is envisaged that in some embodiments, a first curable material is applied and cured, and then subsequently a second curable material is applied and cured.

The radiation used to effect curing is typically UV radiation but could comprise electron beam, visible, or even infra-red or higher wavelength radiation, depending upon the material, its absorbance and the process used. Examples of suitable curable materials include UV curable acrylic based clear embossing lacquers or those based on other compounds such as nitro-cellulose. A suitable UV curable lacquer is the product UVF-203 from Kingfisher Ink Limited or photopolymer NOA61 available from Norland Products. Inc., New Jersey.

The curable material could be elastomeric and therefore of increased flexibility. An example of a suitable elastomeric curable material is aliphatic urethane acrylate (with suitable cross-linking additive such as polyaziridine).

Examples of materials used to effect the optical characteristic(s) in order to provide tinted regions of the light control layer or optical characteristic layer include conventional dyes or pigments which are applied to the polymer resin used to form the light control layer or included directly in the polymer film during the manufacturing process. Such methods for tinting/colouring polymer materials are well known in the art. One example range of colourants would be the BASF Orasol® product range.

Additionally or alternatively, the curable material may comprise at least one substance which is not visible under illumination within the visible spectrum and emits in the visible spectrum under non-visible illumination, preferably UV or IR. In preferred examples, the materials used to effect such optical characteristic(s) include: luminescent, phosphorescent, fluorescent, magnetic, thermochromic, photochromic, iridescent, metallic, optically variable or pearlescent pigments.

Subsequent to the manufacturing of the device, the polymer carrier substrate may be removed, if not being used as the tinted or opaque coloured layer of the device.

Security devices of the sort described above can be incorporated into or applied to any article for which an authenticity check is desirable. In particular, such devices may be applied to or incorporated into documents of value such as banknotes, passports, driving licenses, cheques, identification cards etc.

The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer base substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 15 to 18.

Figure 15A:
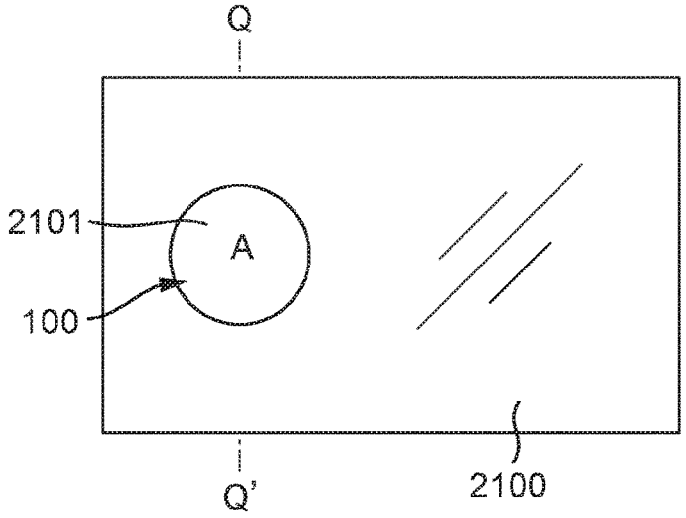
FIGS. 15 to 18 illustrate example documents of value and methods for integrating a security device into said documents of value.
Figure 15B:
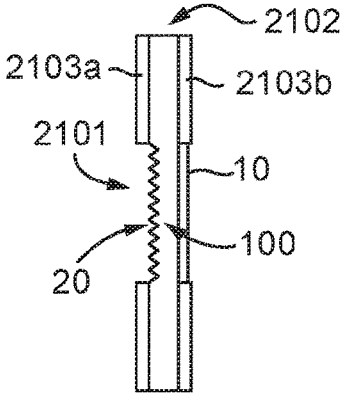

FIG. 15 depicts an exemplary document of value 2100, here in the form of a banknote. FIG. 15*a* shows the banknote in plan view whilst FIG. 15*b* shows the same banknote in cross-section along the line Q-Q'. In this case, the banknote is a polymer (or hybrid polymer/paper) banknote, having a transparent substrate 2102. Two opacifying layers 2103*a* and 2103*b* are applied to either side of the transparent substrate 2102, which may take the form of opacifying coatings such as white ink, or could be paper layers laminated to the substrate 2102.

The opacifying layers 2103*a* and 2103*b* are omitted across an area 2101 which forms a window within which the security device 100 is located. As shown best in the cross-section of FIG. 15*b*, a colour shifting element 10 is provided on one side of the transparent substrate 2102, and a light control layer 20 is provided on the opposite surface of the substrate such that light from the colour shifting element interacts with the light control layer (however the colour shifting element and the light control layer may alternatively be provided on the same side of the substrate). The colour shifting element 10 and light control layer 20 are each as described above with respect to any of the disclosed embodiments, such that the device 100 displays an optically variable effect in window 2101 upon tilting the device (an image of the letter "A" is depicted here as an example). In the example shown in FIG. 15, the light control layer comprises as least a region having a first optical characteristic such that it exhibits a colour, and no tinted coloured layer or opaque coloured layer are present (although it will be appreciated that in other embodiments they may be present). The device 100 may be viewed in transmission or reflection. In the case where it is to be viewed in reflection it is desirable to use a substantially opaque colour shifting element such as a printed ink comprising an optically variable pigment, although a partially transparent colour shifting element may be used in conjunction with an absorbing element as described above. It should be noted that in modifications of this embodiment the window 2101 could be a half-window with the opacifying layer 2103*b* continuing across all or part of the window over the colour shifting element 10. The banknote may also comprise a series of windows or half-windows. In this case different areas displayed by the security device could appear in different ones of the windows, at least at some viewing angles, and could move from one window to another upon tilting.

Figure 16A:
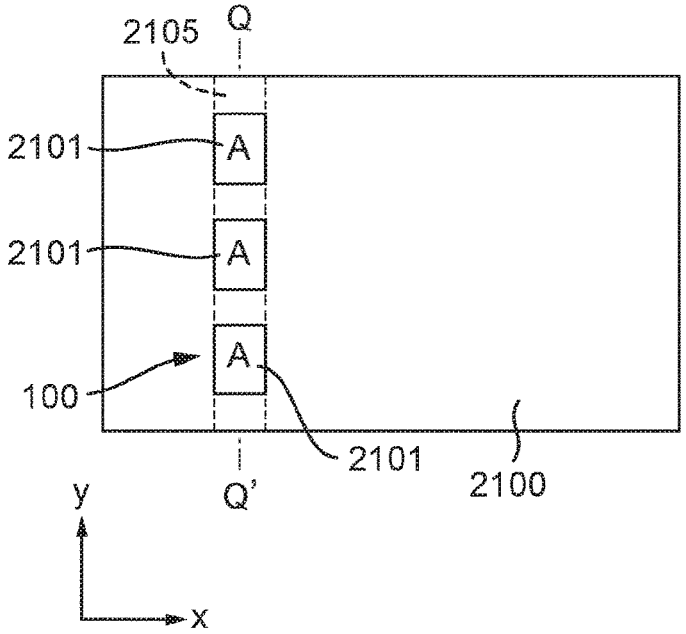
Figure 16B:
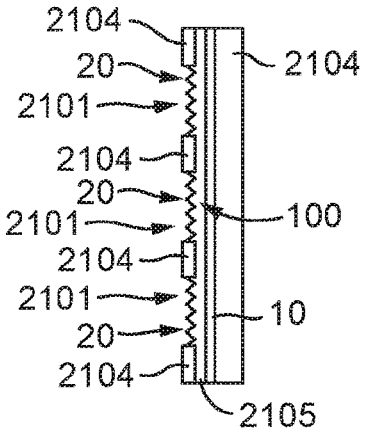

FIG. 16 shows such an example, although here the banknote 2100 is a conventional paper-based banknote provided with a security article 2105 in the form of a security thread, which is inserted during paper-making such that it is partially embedded into the paper so that portions of the paper 2104 lie on either side of the thread. This can be done using the techniques described in EP0059056 where paper is not formed in the window regions during the paper making process thus exposing the security thread in is incorporated between layers of the paper. The security thread 2105 is exposed in window regions 2101 of the banknote. Alternatively the window regions 2101 may for example be formed by abrading the surface of the paper in these regions after insertion of the thread. The security device 100 is formed on the thread 2105, which comprises a transparent substrate with light control layer 20 provided on one side and a colour shifting element 10 provided on the other. In the illustration of FIG. 16(*b*) the colour shifting element is provided continuously along one side of the thread 2105 and the light control layer is depicted as being discontinuous between each exposed region of the thread. However, in practice typically this will not be the case and the security device 100 will be formed continuously along the thread.

If desired, several different security devices 100 could be arranged along the thread, with different optical effects displayed by each. In one example, a first window could contain a first security device, and a second window could contain a second security device, both devices having light control layer surface reliefs comprising linear microprisms, with the linear microprisms of each device arranged along different (preferably orthogonal) directions, so that the two windows display different effects upon tilting in any one direction. For instance, the central window may be configured to exhibit a colour change effect when the document 100 is tilted about the x axis whilst the devices in the top and bottom windows remain uniform in colour, and vice versa when the document is tilted about the y axis. The light control layers of the security devices may have different arrangements (e.g. optical characteristics) such that different windows appear different colours upon tilting.

Figure 17A:
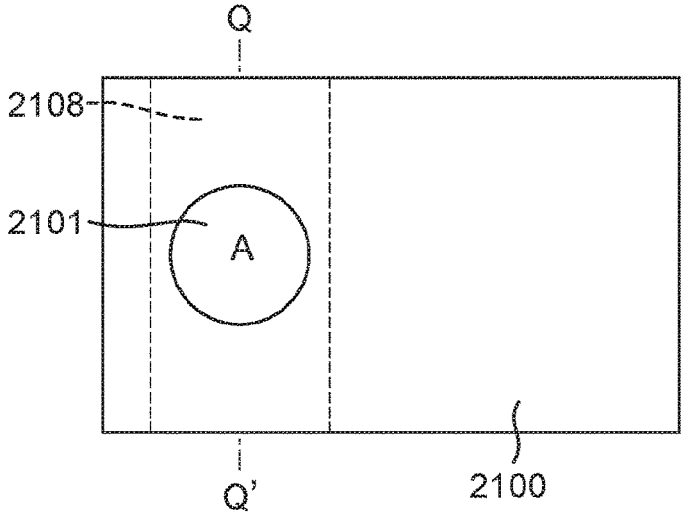
Figure 17B:
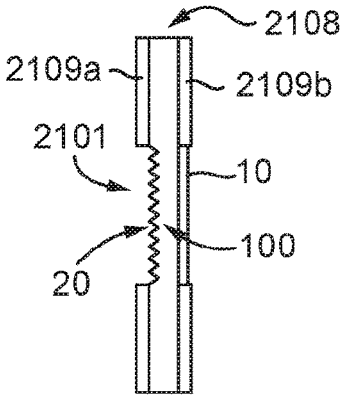

In FIG. 17, the banknote 2100 is again a conventional paper-based banknote, provided with a strip element or insert 2108. The strip 2108 is based on a transparent substrate and is inserted between two plies of paper 2109*a* and 2109*b*. The security device 100 is formed by a light control layer 20 on one side of the strip substrate, and a colour shifting element 10 on the other. The paper plies 2109*a* and 2109*b* are apertured across region 2101 to reveal the security device 100, which in this case may be present across the whole of the strip 2108 or could be localised within the aperture region 2101. The colour shifting element 10 is visible through the light control layer 20 due to the transparent nature of the strip 2108.

Figure 18A:
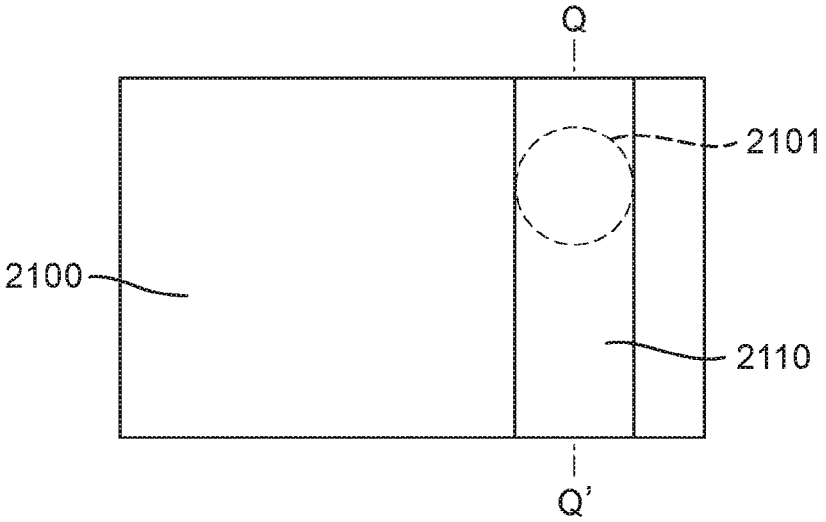
Figure 18B:
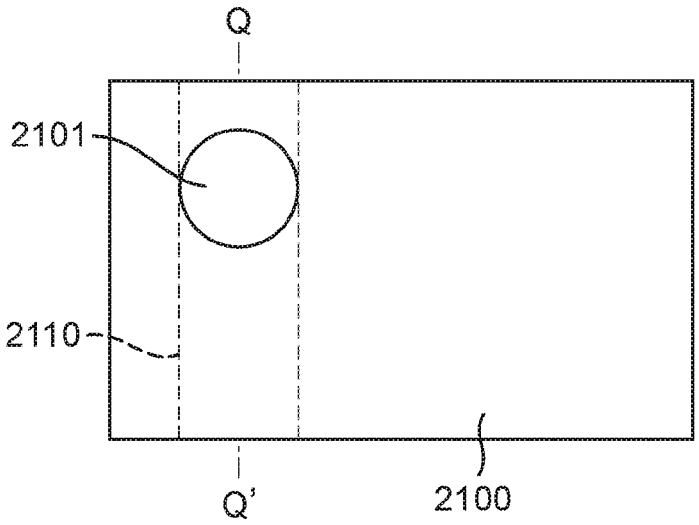
Figure 18C:
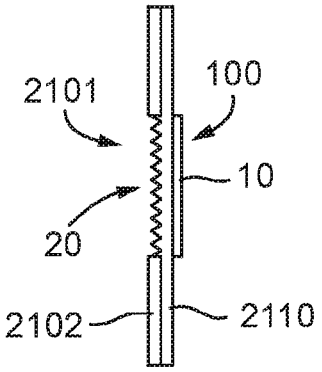

A further embodiment is shown in FIG. 18 where FIGS. 18(*a*) and (*b*) show the front and rear sides of the document 2100 respectively, and FIG. 18(*c*) is a cross section along line Q-Q'. Security article 2110 is a strip or band comprising a security device 100 according to any of the embodiments described above. The security article 2110 is formed into a security document 2100 comprising a fibrous substrate 2102, using a method described in EP-A-1141480. The strip is incorporated into the security document such that it is fully exposed on one side of the document (FIG. 18(*a*)) and exposed in one or more windows 2101 on the opposite side of the document (FIG. 18(*b*)). Again, the security device is formed on the strip 2110, which comprises a transparent substrate with a light control layer 20 formed on one surface and colour shifting element 10 formed on the other.

In FIG. 18, the document of value 2100 is again a conventional paper-based banknote and again includes a strip element 2110. In this case there is a single ply of paper. Alternatively a similar construction can be achieved by providing paper 2102 with an aperture 2101 and adhering the strip element 2110 on to one side of the paper 2102 across the aperture 2101. The aperture may be formed during papermaking or after papermaking for example by die-cutting or laser cutting. Again, the security device is formed on the strip 2110, which comprises a transparent substrate with a light control layer 20 formed on one surface and a colour shifting element 10 formed on the other.

In the examples of FIGS. 15 to 18, the colour shifting element and light control layer are described as being on opposing side of a transparent substrate. However in other examples they may be provided on the same side of the transparent substrate. In the case where an at least partially transparent coloured layer and/or substantially opaque coloured layer is provided, any arrangement of the layers may be used as described in any of the above embodiments.

Figure 19A:
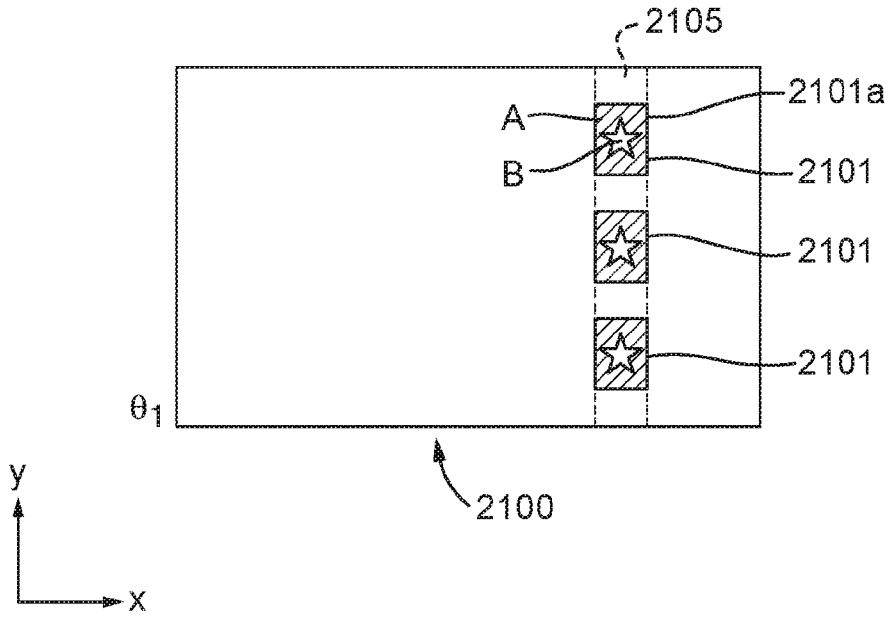
FIGS. 19 and 20 illustrate specific examples of security devices integrated within a document of value, together with the exhibited visual effect.
Figure 19B:
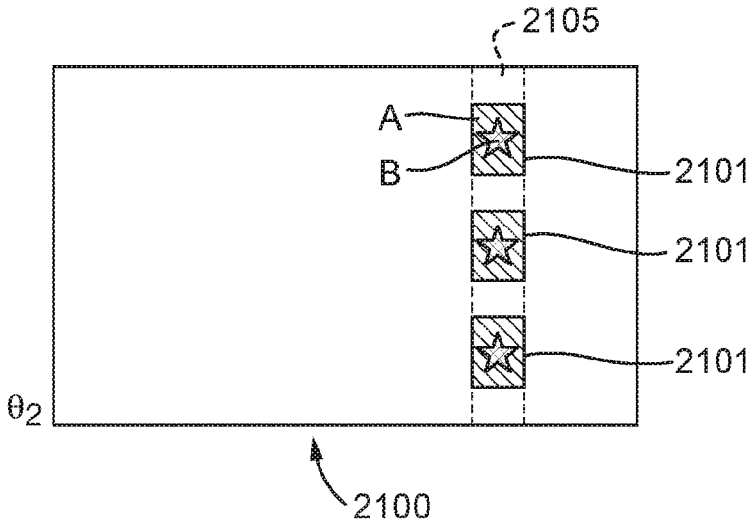

FIG. 19 illustrates an example security document in the form of a banknote 2100 in more detail. The banknote is provided with a security thread 2105 as described above, with the thread being exposed in window regions 2101 of the banknote substrate. Each exposed window region 2101 exhibits the same effect, and so we will consider window 2101*a* only for ease of description. Here, a security device is provided comprising a red to green colour shift element and a light control layer comprising an array of linear triangular microprisms having their long axes in a direction substantially parallel to the long axis of the banknote paper (here the x axis). A region of the light control layer defining a star indicia (shown at B) is formed so as to have an optical absorption coefficient such that it exhibits a yellow tint. An absorbing layer is provided contiguously beneath the colour shifting element such that the visual effects of the device are intended to be viewed in reflection.

Therefore, at a normal angle of viewing Θ1, region A (comprising the colour shifting element and a colourless region of the light control layer) exhibits a red colour and region B exhibits an orange colour. Upon tilting the banknote about an axis parallel with the x axis and viewing at angle Θ2, region A exhibits a blue colour, and region B exhibits a turquoise colour. This colour change is illustrated by the different shading.

Figure 20A:
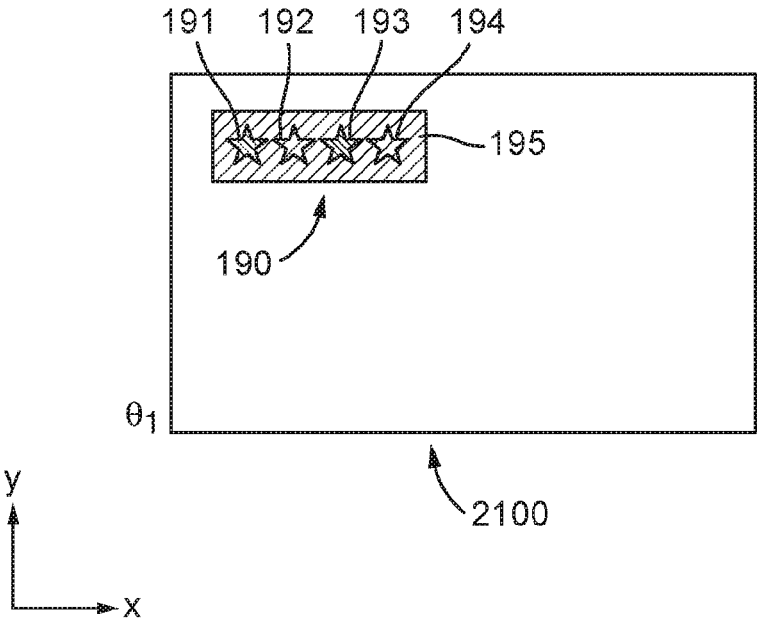
Figure 20B:
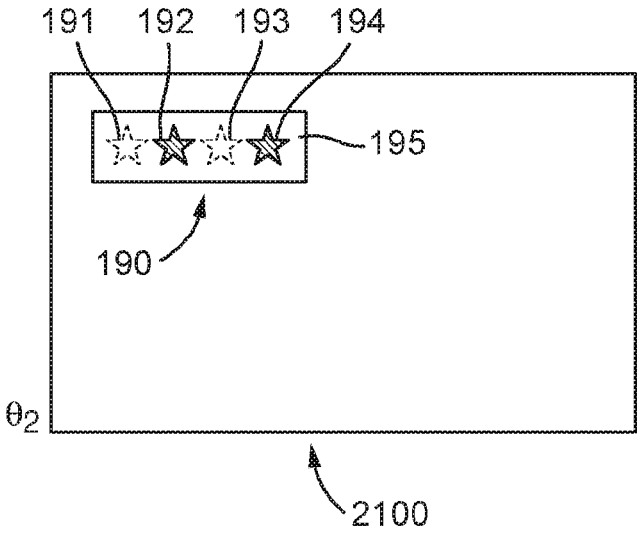

FIG. 20 illustrates an example security document 2100 in the form of a polycarbonate data page, for example for a passport or identity card. A security device 190 is affixed to the surface of the data page, for example through the use of a pressure-sensitive adhesive. Alternatively, it is envisaged that the surface relief of the light control layer of the device may be formed as part of the polycarbonate page itself.

In this example, the device 190 comprises a colour shifting element and contiguous absorbing layer as described above in relation to FIG. 19. The light control layer also comprises a plurality of microprisms. However, here, the microprisms are arranged to as to define a series of star shaped indicia 191, 192, 193, 194. The microprisms are arranged with their long axes substantially parallel to the long axis of the data page (here the x axis), with the length of the microprisms along this axis differing so as to define the star shapes. Area 195 of the device surrounding the star indicia is either left as exposed colour shifting element or comprises a planar layer of light control layer material such that the angle of light from the colour shifting element is not substantially modified. The microprisms defining stars 191 and 193 have an optical characteristic such that they exhibit a yellow colour, and the microprisms defining stars 192 and 194 are substantially colourless.

Therefore, at a normal angle of viewing Θ1, surrounding area 195 appears red, as do stars 192 and 194. Stars 191 and 193 appear orange. Therefore, at Θ1, only two stars are discernible to a viewer, specifically stars 192 and 194 appearing orange against a red background.

However, upon tilting the passport page (and therefore the device) about the x axis, background region 195 exhibits a green colour, stars 191 and 193 exhibit a green-turquoise colour (mixture of blue and yellow light), and stars 192 and 194 appear blue. Therefore, at Θ2, the device exhibits two blue stars 192 and 194 against a green background as the stars 191 and 193 are not easily discernible against the background at this viewing angle. This is a particularly striking visual effect as not only does the device appear to change colour, but the locations of the indicia appear to move upon tilting the device.

Figure 21A:
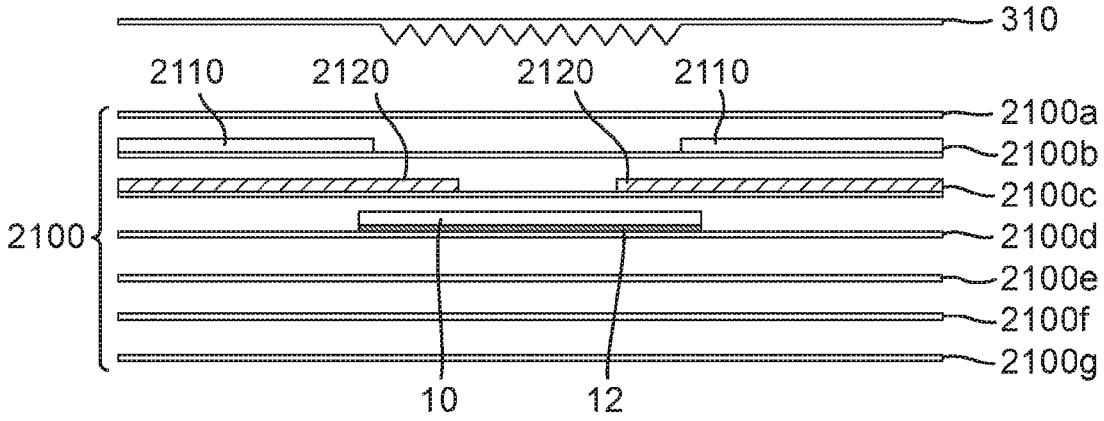
FIGS. 21*a*, 21*b* and 22 illustrate example polymer substrates incorporating security device according to the invention.

FIG. 21*a* is a schematic cross-section of a polymer substrate 2100 suitable for a data page, such as for a passport or identity card. A security device according to the invention may be incorporated into such a substrate, as will be described below. The substrate 2100 comprises a plurality of overlapping self-supporting polymer layers 2100*a*, 2100*b*, . . . , 2100*g*, typically comprising polycarbonate. First and second outer layers 2100*a*, 2100*g* each provide outwardly facing surfaces that define outwardly facing surfaces of the substrate. The substrate 2100 also comprises a number of internal layers 2100*b*, 2100*c*, . . . , 2100*f*. Typically the first and second outer layers are substantially transparent to visible light, and the layers 2100*b*, 2100*c* positioned between the colour shifting element 10 and the uppermost outer layer 2100*a* are substantially transparent such that the optical effects of the colour shifting element 10 can be viewed through the uppermost outer layer. The layer 2100*d* on which the colour shifting element is provided, and any layer between the colour shifting layer and the bottom-most outer layer 2100*g* are substantially opaque and typically white in colour. In this example the colour shifting element 10 is partially transparent and designed to be viewed in reflection, and so an absorbing element 12 is also provided.

Figure 13:
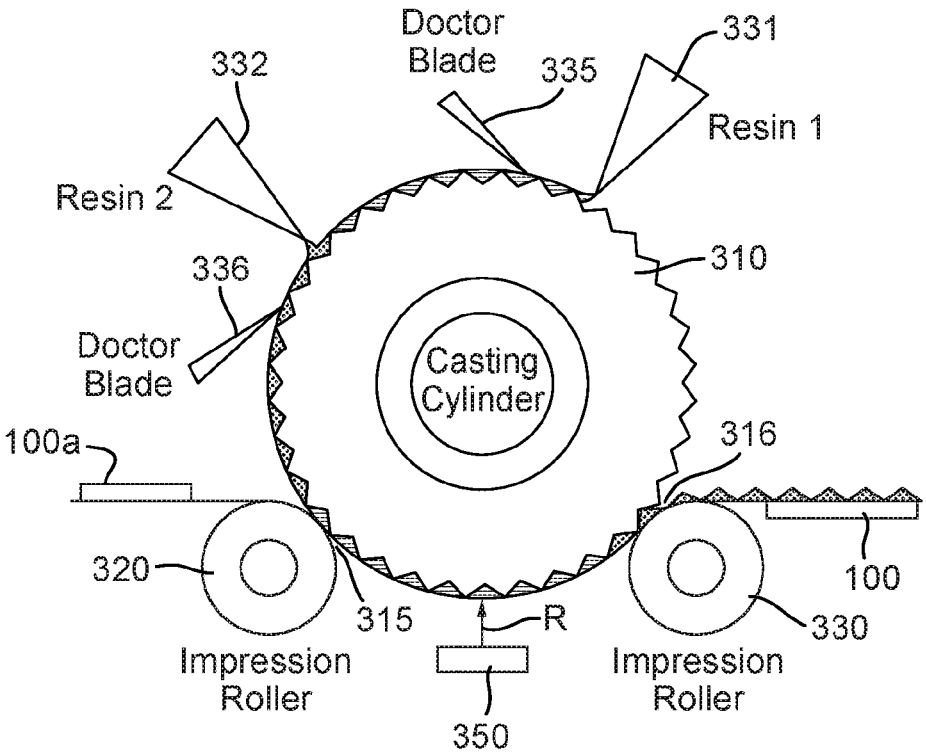
FIGS. 13 and 14 schematically illustrate example methods of manufacturing a security device according to the invention.

The light control layer is provided in the outwardly facing surface of the uppermost outer layer 2100*a*, typically by embossing by a casting cylinder 310, similar to as seen in FIGS. 13 and 14. This may be done substantially simultaneously with fusing the layers together (typically by laminating) or in a separate step. In the example shown in FIG. 21*a*, layer 2100*b* is substantially transparent and provided with printed opaque white region 2110 outside the area of the colour shifting element 10. Layer 2100*c* is substantially transparent and provided with an at least partially transparent printed region 2120 having a coloured tint. The tinted region partially overlaps with the colour shifting element 10 such that the combination of optical effects is seen in the regions of overlap.

Figure 21B:
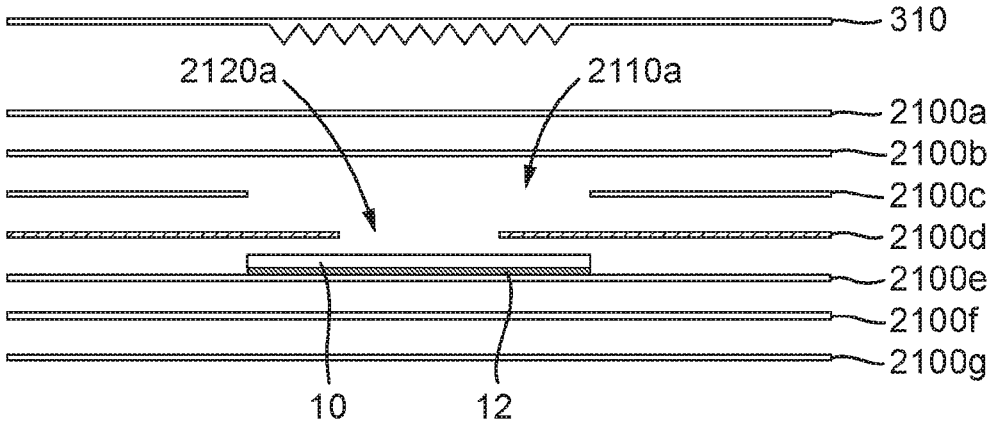

Alternatively, as seen in FIG. 21*b*, layer 2100*c* may comprise substantially opaque white polycarbonate having an aperture region 2110*a* corresponding to the area of the colour shifting element. Similarly, layer 2100*d* comprises tinted polycarbonate having an aperture region 2120*a* such that at least a part of the tinted polycarbonate overlaps with the colour shifting element and the combination of optical effects can be seen.

Figure 22:
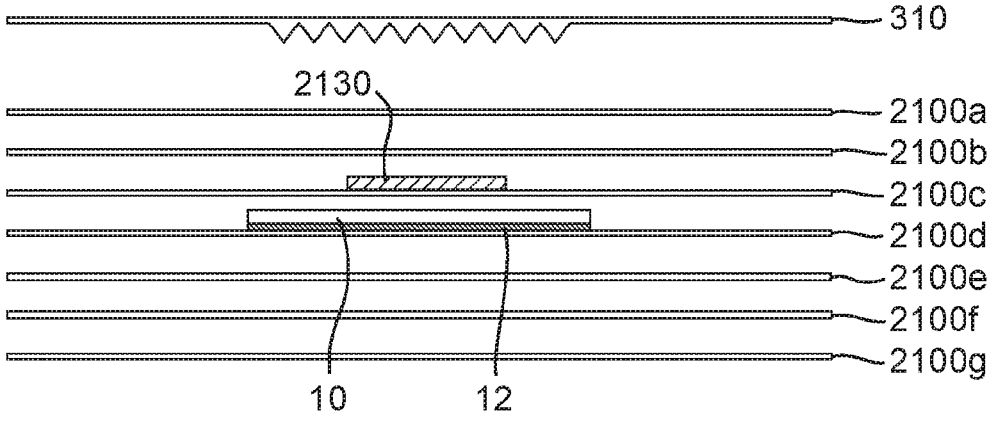

FIG. 22 illustrates a similar polymer substrate 2100 to the one described above with reference to FIGS. 21*a* and 21*b*. Here however, a partially transparent tinted region 2130 is provided on a transparent polymer layer 2100*c* above the colour shifting layer. The tinted region may be provided by printing, or may be applied as a patch. Such a region may define indicia, and may be applied to any layer between the colour shifting element and the light control layer in the outer surface of the device.

Figure 23:
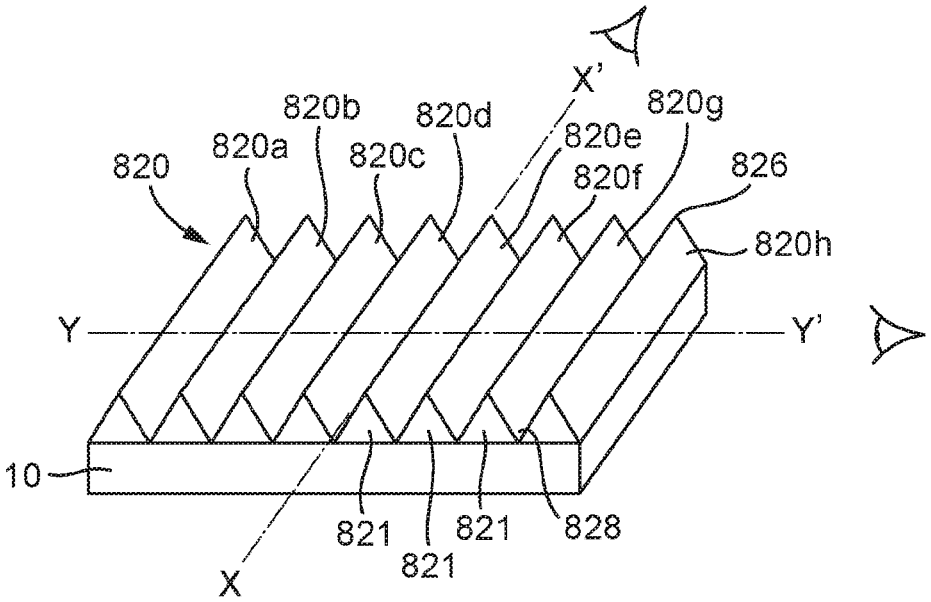
FIGS. 23 to 30 are aerial views of various surface reliefs that may be used in a light control layer of a security device according to the invention.

The above embodiments have been described with respect to the light control layer comprising a microprismatic structure comprising a plurality of linear microprisms. FIG. 23 is an aerial perspective view of such a light control layer structure, shown generally at 820. The microprismatic structure comprises an array of linear microprisms 820*a*, 820*b* . . . 820*h* each having a triangular cross section (shown generally at 821). The linear microprisms substantially abut each other along their long axes, and are parallel with each other about their long axes. The array of microprisms defines a series of elevations 26 and depressions 28.

Opposing end faces of an individual microprism are substantially parallel, and such a microprism is known as a "one-dimensional" microprism. The microprismatic structure 820 shown in FIG. 23 is therefore a one-dimensional microstructure as it comprises a plurality of one-dimensional microprisms. The term "one-dimensional" is used because the optical effect produced by the microprism is significantly stronger (i.e. more noticeable to a viewer) in one direction of viewing. In the example of FIG. 23, the effect of the surface relief (i.e. an exhibited red to blue colour shift) is most noticeable if viewed along a direction Y-Y' perpendicular to the long axes of the microprisms.

The optical effect exhibited by the light control layer is therefore anisotropic. If the security device comprising the light control layer is rotated within its plane, the exhibited optical effect due to the combination of colour shifting element and light control layer is seen most readily when the device is tilted with the viewing direction perpendicular to the long axes of the microprisms (i.e. along Y-Y'). If the device is rotated such that the viewing direction is parallel with the long axes of the microprisms (i.e. along X-X'), the effect is seen to a lesser extent.

A variety of different surface relief structures can be used for a security device according to the present invention, as will be highlighted with reference to the following FIGS. 24 to 30.

Figure 24:
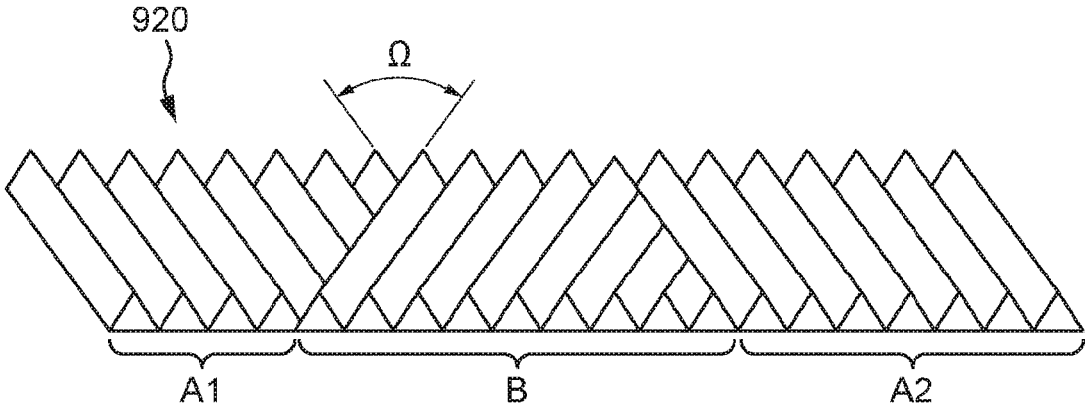

FIG. 24 illustrates an example light control layer 920 that comprises three regions A1, B and A2, each comprising a plurality of microprisms. The microprisms in each region are parallel with each other, and the microprisms of regions A1 and A2 are parallel. However, the microprisms of region B are offset from those of regions A1 and A2, such that the long axes of the microprisms of regions A1 and A2 define an angle Ω with the long axes of region B. Thus, the functional region 920 will provide a modifying optical effect when tilted and viewed along a direction perpendicular to the long axes of the microprisms of regions A1 and A2, as well as a readily seen optical effect when functional region 920 is rotated and viewed from a direction perpendicular to the long axes of region B. This is in contrast to the surface relief of FIG. 23, where the long axes of the microprisms are aligned in a single direction.

Figure 25:
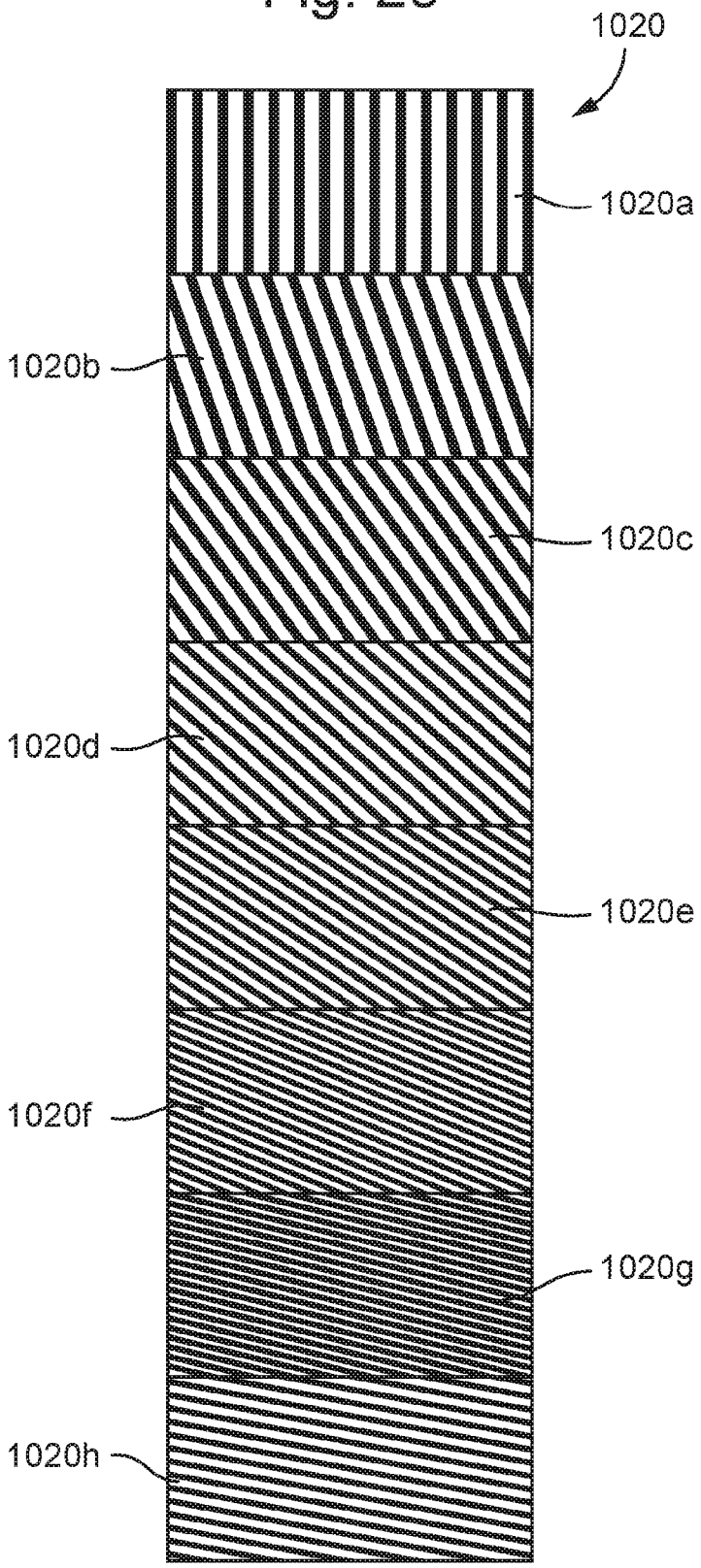

It is envisaged that a light control layer may comprise a plurality of regions offset from each other can be used, as shown in FIG. 25. FIG. 25 schematically illustrates a functional region 1020 comprising a plurality of linear microprisms arranged in a plurality of arrays 1020*a*, 1020*b* . . . 1020*h* rotationally offset to each other.

Figure 26:
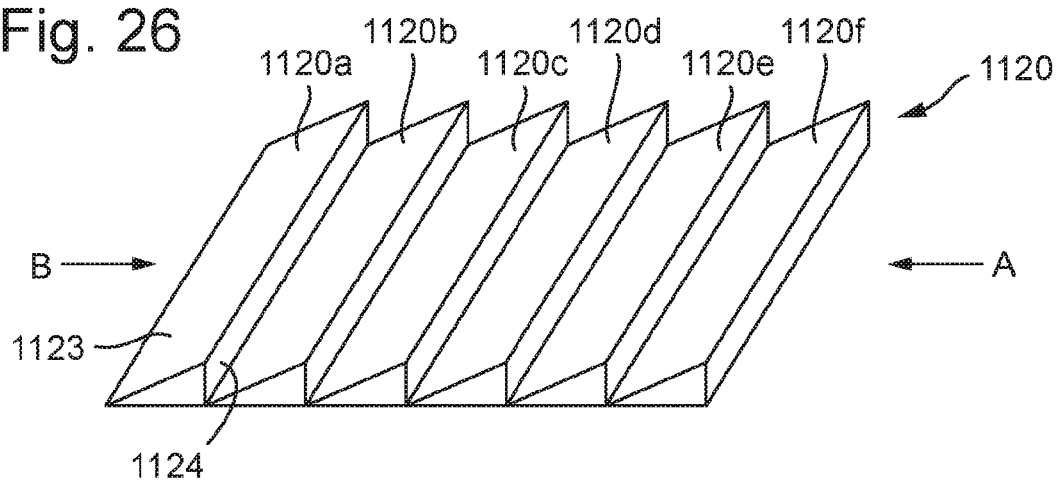

FIG. 26 illustrates a light control layer comprising a plurality of microprisms 1020*a*, 1020*b* . . . 1020*f* each having a "saw-tooth" structure, in that one facet (shown here at 1123) defines a more acute angle with the outer surface of the security device than the other facet of the microprism (shown at 1124). Such a saw-tooth structure, when viewed from direction A, will provide a colour shift effect that occurs over a narrow angle of tilt. Conversely, when viewed from direction B, the colour shift occurs over a relatively large angle of tilt.

Figure 27:
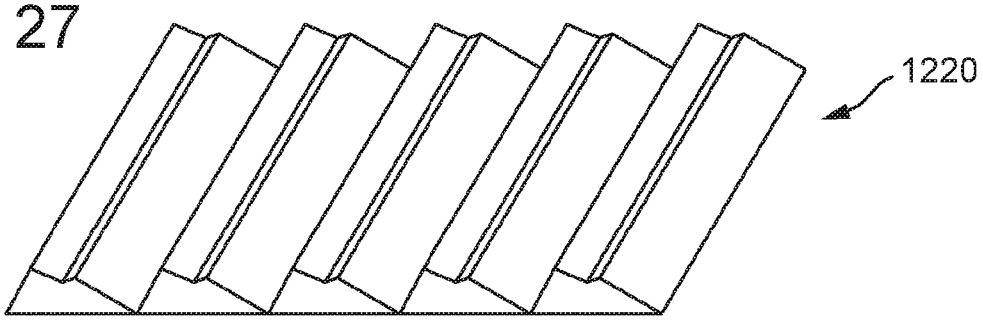
Figure 28:
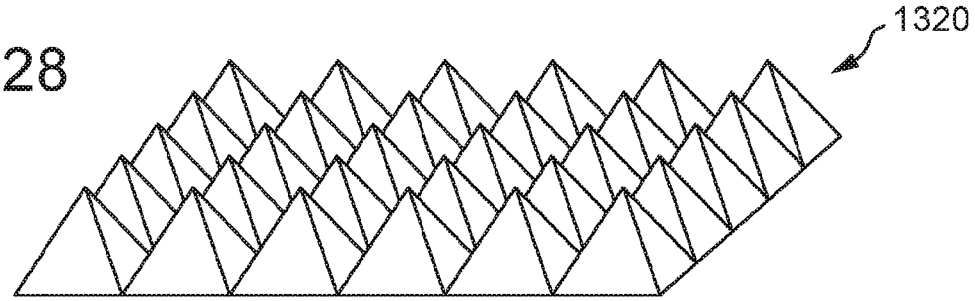
Figure 29:
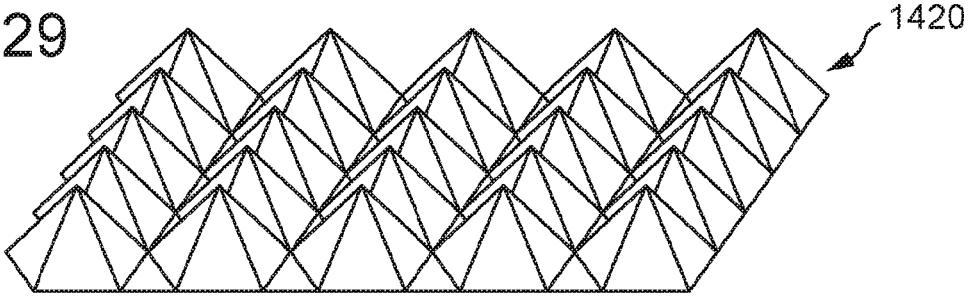

The light control layer may comprise a series of multi-faceted microprisms (i.e. having more than two facets), as shown in the surface relief 1120 of FIG. 27.

To obtain more isotropy in the optical properties of the light control layer, a "two-dimensional" microprismatic structure may be used comprising microprisms that are not as rotationally dependent as the linear microprisms of FIG. 23 for example. Such examples include corner cubes, square based pyramid microprisms as depicted in the light control layer structure 1320 of FIG. 28, or more generally polygon-based pyramidal microprisms such as the hexagonal based pyramidal microprisms seen in the example light control layer surface relief 1420 of FIG. 29.

Figure 30:
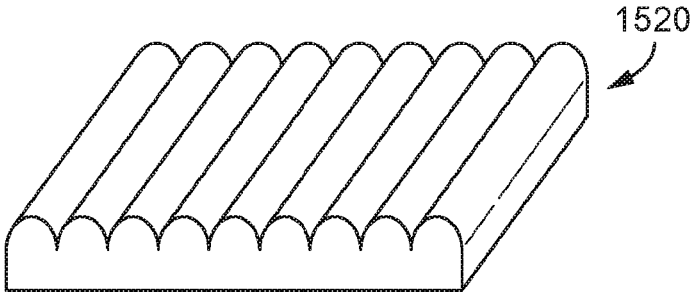

FIG. 30 depicts a light control layer surface relief 1520 which has a structure similar to a microprismatic structure, but instead of microprisms comprises an array of lecticules with a domed surface structure.

Any of the security devices described above may preferably further comprise a magnetic layer or another functional substance such as a fluorescent, phosphorescent or luminescent material. These can be incorporated into existing layers or added as separate layers.

In all of the embodiments described above, the security level can be increased further by incorporating a magnetic material into the device. This can be achieved in various ways. For example an additional layer may be provided which may be formed of, or comprise, magnetic material. The whole layer could be magnetic or the magnetic material could be confined to certain areas, e.g. arranged in the form of a pattern or code, such as a barcode. The presence of the magnetic layer could be concealed from one or both sides, e.g. by providing one or more masking layer(s).

The invention claimed is:

1. A security device comprising:

a color shifting element that exhibits different wavelengths of light at different viewing angles, and;

an at least partially transparent light control layer covering at least a part of the color shifting element and comprising a surface relief adapted to modify, by refraction, the angle of light from the color shifting element, wherein:

a first region of the light control layer comprises a first optical characteristic, whereby light at a first viewing angle from the first region of the light control layer is perceived to have a resultant optical effect that is the result of the wavelength of light exhibited at that viewing angle due to the combination of the color shifting element and the surface relief of the light control layer, and the first optical characteristic, wherein the first optical characteristic is any of: a visible color, a level of transparency, fluorescence, luminescence and phosphorescence, and;

a second region of the light control layer either:

(i) is substantially colorless and does not comprise the first optical characteristic such that light at the first viewing angle from the second region is perceived to have a resultant optical effect exhibited at that viewing angle due to the combination of the color shifting element and the surface relief of the light control layer of the second region, or (ii) comprises a second optical characteristic different from the first optical characteristic, whereby light at the first viewing angle from the second region of the light control layer is perceived to have a resultant optical effect that is the result of the wavelength of light exhibited at that viewing angle due to the combination of the color shifting element and the surface relief of the light control layer, and the second optical characteristic, wherein the second optical characteristic is any of: a visible color, a level of transparency, fluorescence, luminescence and phosphorescence.

2. The security device of claim 1, wherein the resultant optical effect is a perceived color.

3. The security device of claim 1, wherein the first optical characteristic is such that, at the first viewing angle, the first region exhibits a first visible color and the second optical characteristic is such that the second region exhibits a second, different visible color.

4. The security device of claim 1, wherein the first and second optical characteristics are such that the first region and the second region exhibit substantially the same visible color, wherein the level of transparency of the first region is different from the level of transparency of the second region such that the resultant perceived colors exhibited by the first and second regions are different.

5. The security device of claim 1, wherein at a first viewing angle, the light from the first region of the light control layer is perceived to have a first resultant color and, at a second viewing angle, the light from said first region of the light control layer is perceived to have a second resultant color different from the first resultant color.

6. The security device of claim 1, wherein the first and/or second regions of the light control layer define indicia.

7. A security device comprising:

a color shifting element that exhibits different wavelengths of light at different viewing angles;

an at least partially transparent light control layer covering at least a part of the color shifting element and comprising a surface relief adapted to modify the angle of light from the color shifting element, and;

an optical characteristic layer positioned between the color shifting element and the light control layer, or positioned on a distal side of the color shifting element with respect to the light control layer, wherein at least a first region of the optical characteristic layer comprises a first optical characteristic such that it exhibits a first optical effect at substantially all viewing angles;

whereby light at a first viewing angle from the first region is perceived to have a first optical effect that is the result of the wavelength of light exhibited at that viewing angle due to the combination of the color shifting element and the surface relief of the light control layer, and the first optical characteristic.

8. The security device of claim 7, wherein the first optical characteristic is any of: a visible color, fluorescence, luminescence and phosphorescence.

9. The security device of claim 7, wherein the optical characteristic layer comprises a second region having a second optical characteristic such that the second region exhibits a second optical effect at substantially all viewing angles different to the first optical effect.

10. The security device of claim 9, wherein the first and second optical characteristics are such that the first region and the second region exhibit substantially the same visible color, wherein a level of transparency of the first region is different to a level of transparency of the second region.

11. The security device of claim 7, wherein the optical characteristic layer defines indicia.

12. A security device comprising:

a color shifting element that exhibits different wavelengths of light at different viewing angles;

an at least partially transparent light control layer covering at least a part of the color shifting element and comprising a surface relief adapted to modify the angle of light from the color shifting element; and a substantially opaque layer having a first optical characteristic positioned between the color shifting element and the light control layer and covering a first region of the color shifting element, wherein a first region of the light control layer comprises a second optical characteristic, whereby light at a first viewing angle from the first region of the light control layer is perceived to either:

(i) have a resultant optical effect that is the result of the first optical characteristic and the second optical characteristic, when the first region of the light control layer overlaps with the opaque layer, or (ii) have a resultant optical effect that is the result of the wavelength of light exhibited at that viewing angle due to the combination of the color shifting element and the surface relief of the light control layer, and the second optical characteristic, when the first region of the light control layer does not overlap with the opaque layer.

13. The security device of claim 12, wherein the first and/or second optical characteristic is any one of: a visible color, fluorescence, luminescence and phosphorescence.

14. The security device of claim 12, wherein a second region of the light control layer is substantially colorless such that light at the first viewing angle from the second region is perceived to either:

(i) have a resultant optical effect that is the result of the first optical characteristic, when the second region of the light control layer overlaps with the opaque layer, or (ii) have a resultant optical effect that is the result of the wavelength of light exhibited at that viewing angle due to the combination of the color shifting element and the surface relief of the light control layer, when the second region does not overlap with the opaque layer.

15. The security device of claim 12, wherein the first optical characteristic of the substantially opaque layer is a visible color substantially corresponding to the wavelength of light exhibited by the color shifting element at a first viewing angle such that, at said first viewing angle, the device exhibits a substantially uniform color and at a second viewing angle different to the first viewing angle, the device exhibits different regions of color corresponding to the overlap of the substantially opaque layer with the color shifting element.

16. The security device of claim 1, wherein the surface relief comprises at least one microstructure.

17. The security device of claim 16, wherein the microstructure is a linear microprism and the surface relief comprises an array of linear microprisms.

18. A security article comprising a security device according to claim 1.

19. The security device of claim 7, wherein the surface relief comprises at least one microstructure.

20. The security device of claim 12, wherein the surface relief comprises at least one microstructure.

* * * * *